US008898987B1

(12) United States Patent
Amatruda et al.

(10) Patent No.: US 8,898,987 B1
(45) Date of Patent: Dec. 2, 2014

(54) ROOFING SHINGLES WITH REDUCED USAGE OF CONVENTIONAL SHINGLE MATERIAL AND HAVING TOP LAP EXTENSION

(71) Applicants: Anna M. Amatruda, East Norriton, PA (US); Peter Chihlas, Lansdale, PA (US); Gregory F. Jacobs, Oreland, PA (US); Robert L. Jenkins, Honey Brook, PA (US); Stephen A. Koch, Collegeville, PA (US); Jennifer A. Millberg, Boston, MA (US); Richard A. Snyder, Eagleville, PA (US); Dale H. Walton, Royersford, PA (US)

(72) Inventors: Anna M. Amatruda, East Norriton, PA (US); Peter Chihlas, Lansdale, PA (US); Gregory F. Jacobs, Oreland, PA (US); Robert L. Jenkins, Honey Brook, PA (US); Stephen A. Koch, Collegeville, PA (US); Jennifer A. Millberg, Boston, MA (US); Richard A. Snyder, Eagleville, PA (US); Dale H. Walton, Royersford, PA (US)

(73) Assignee: Certainteed Corporation, Valley Forge, PA (US)

( * ) Notice: Subject to any disclaimer, the term of this patent is extended or adjusted under 35 U.S.C. 154(b) by 0 days.

(21) Appl. No.: 13/667,418

(22) Filed: Nov. 2, 2012

Related U.S. Application Data

(60) Provisional application No. 61/555,356, filed on Nov. 3, 2011.

(51) Int. Cl.

| | |
|---|---|
| ***E04D 1/26*** | (2006.01) |
| ***E04D 1/34*** | (2006.01) |
| ***E04D 1/28*** | (2006.01) |

(52) U.S. Cl.
CPC ... *E04D 1/28* (2013.01); *E04D 1/34* (2013.01); *E04D 1/26* (2013.01)
USPC ..... 52/557; 53/552

(58) Field of Classification Search
USPC ..... 52/557, 558, 559, 554, 105, 585, 314, 52/518, 543, 552, 540, DIG. 16; 83/920; D25/139
See application file for complete search history.

(56) References Cited

U.S. PATENT DOCUMENTS

| | | | |
|---|---|---|---|
| 1,340,348 | A | 5/1920 | Rahr |
| 2,013,556 | A | 9/1935 | Eckert |

(Continued)

FOREIGN PATENT DOCUMENTS

| | | | |
|---|---|---|---|
| CA | 363127 | A | 5/1937 |

OTHER PUBLICATIONS

U.S. Appl. No. 13/667,349, filed Nov. 2, 2012, Inventors: Anna M. Amatruda et al.

(Continued)

*Primary Examiner* — William Gilbert
*Assistant Examiner* — Kyle Walraed-Sullivan
(74) *Attorney, Agent, or Firm* — Alexander H. Plache; Abel Law Group, LLP

(57) ABSTRACT

A roofing shingle has a shingle body with a butt edge, a headlap portion, a head edge, and first and second side edges. An exposure zone has a width that extends from the butt edge toward the headlap portion and is configured to be exposed to the environment when the shingle is installed on a roof. A water impermeable sheet is attached to the shingle body. The sheet has a width with upper and lower edges. The width extends from between about the butt and head edges to beyond the head edge of the shingle body. The width of the shingle body is such that a first distance between the head edge of the shingle body and the upper edge of the water impermeable sheet is equal to or greater than the width of the exposure zone. The sheet is formed from a different material than the shingle body.

21 Claims, 13 Drawing Sheets

(56) References Cited

U.S. PATENT DOCUMENTS

| | | | | |
|---|---|---|---|---|
| 3,415,029 | A | 12/1968 | Coletta | |
| 4,010,590 | A | 3/1977 | Reinke | |
| 4,023,321 | A | 5/1977 | Smith | |
| 4,050,209 | A | 9/1977 | Barker et al. | |
| 4,102,107 | A | 7/1978 | Barker et al. | |
| 4,194,335 | A * | 3/1980 | Diamond | 52/419 |
| 4,352,837 | A | 10/1982 | Kopenhaver | |
| 4,459,788 | A | 7/1984 | Bockwinkel et al. | |
| 4,706,435 | A * | 11/1987 | Stewart | 52/533 |
| 4,731,970 | A | 3/1988 | Marshall et al. | |
| 5,094,058 | A | 3/1992 | Slocum | |
| 5,181,361 | A | 1/1993 | Hannah et al. | |
| 5,287,669 | A | 2/1994 | Hannah et al. | |
| 5,295,339 | A | 3/1994 | Manner | |
| 5,347,785 | A | 9/1994 | Terrenzio et al. | |
| 5,375,491 | A | 12/1994 | Hannah et al. | |
| 5,421,134 | A | 6/1995 | Hannah et al. | |
| 5,426,902 | A | 6/1995 | Stahl et al. | |
| 5,428,931 | A | 7/1995 | Radsdale | |
| 6,708,456 | B2 | 3/2004 | Kiik et al. | |
| 6,877,288 | B2 * | 4/2005 | Shirota | 52/416 |
| 6,936,329 | B2 * | 8/2005 | Kiik et al. | 428/141 |
| 6,990,779 | B2 | 1/2006 | Kiik et al. | |
| 7,448,177 | B2 | 11/2008 | McClintick | |
| 7,454,873 | B2 | 11/2008 | McClintick | |
| 7,537,820 | B2 | 5/2009 | Kalkanoglu et al. | |
| 8,557,366 | B2 | 10/2013 | Harrington et al. | |
| 8,667,758 | B2 | 3/2014 | Fernandez Fernandez | |
| 2003/0097811 | A1 * | 5/2003 | Becker et al. | 52/518 |
| 2003/0230040 | A1 | 12/2003 | Shirota | |
| 2004/0182032 | A1 * | 9/2004 | Koschitzky | 52/518 |
| 2006/0059832 | A1 | 3/2006 | McClintick | |
| 2006/0201094 | A1 | 9/2006 | Lassiter | |
| 2007/0039274 | A1 * | 2/2007 | Harrington et al. | 52/518 |
| 2007/0042158 | A1 * | 2/2007 | Belt et al. | 428/143 |
| 2007/0094976 | A1 | 5/2007 | McClintick | |
| 2007/0151171 | A1 | 7/2007 | McClintick | |
| 2008/0155923 | A1 * | 7/2008 | Teng et al. | 52/409 |
| 2011/0041446 | A1 | 2/2011 | Stephens et al. | |
| 2011/0061326 | A1 | 3/2011 | Jenkins | |

OTHER PUBLICATIONS

U.S. Appl. No. 13/667,443, filed Nov. 2, 2012, Inventors: Anna M. Amatruda et al.

Technical search, 4 pgs, 2012.

Technical search, 7 pgs, 2012.

* cited by examiner 321
305
315
302
311
301
$L_{sb}=L_{tot}=L_{wis}$
$W_{tot}$
$W_{tl}$
$W_{sb}$
$W_{fz}$
$W_{ez}$ 325
323
$W_{ol}$
$W_{os}$
$W_{wis}$
303

ROOFING SHINGLES WITH REDUCED USAGE OF CONVENTIONAL SHINGLE MATERIAL AND HAVING TOP LAP EXTENSION

This application claims priority to and the benefit of U.S. Provisional Patent Application No. 61/555,356, filed Nov. 3, 2011, which is incorporated herein by reference in its entirety.

BACKGROUND OF THE INVENTION

Field of the Disclosure

In the art of shingle and siding manufacture, it is known to manufacture shingles of an asphalt impregnated organic or inorganic web, having granules on an outer surface thereof, and having smaller particles on an opposite surface, comprising complete layers of shingle material, examples of which are present in U.S. Pat. Nos. 4,352,837; 5,181,361; 5,287,669; 5,347,785; 5,375,491; 5,421,134; 5,426,902, as well as many other patents. Sometimes, these shingles are comprised of a plurality of complete layers of shingle material, adhered together as a laminate, and sometimes they are comprised of a single complete layer of shingle material, with or without an overlay comprised of an additional layer of adhesive, and an additional layer of granules applied thereto. In addition to structures such as the above identified shingles functioning as shingles, sometimes similar structures are used to function as components of siding, to be applied to side walls of a building structure, rather than the roof of a building structure.

An object of the invention is to provide a roofing shingle product having reduced usage of conventional shingle materials while still closing a roof to protect a structure from the environment. Simply eliminating a headlap portion of a shingle and leaving the fastening zone and exposure zone in place for installation and application of shingles can produce the appearance and aesthetic effect of a shingled roof. However, typical headlaps extend above the exposure zone to a distance higher than the first overlying course of shingles and to a point where they at least in part underlie the lower end of the second overlying course of shingles. Removal of a significant portion of the headlap shingle material can leave potential leak points between pairs of adjacent shingles where no shingle material is beneath a joint between adjacent shingles. This invention provides a solution to the problem of closing a shingle installation using shingles having exposure zones of conventional shingle materials and reduced amounts of conventional material above the exposure zone.

US 20070039274A1 discloses a roofing shingle includes a buttlap portion with a butt edge and a headlap portion with a head edge. The roofing shingle includes a coated mat which is a roofing mat coated with an organic-based coating material. The roofing shingle also includes a water impermeable sheet adjacent to the coated mat. In one embodiment, the headlap portion of the coated mat is mostly replaced by the sheet. In another embodiment, the roofing shingle has a limited width. In a further embodiment, the roofing shingle is reduced in weight compared to a conventional shingle.

U.S. Pat. No. 6,708,456 discloses roofing composite comprising a roofing material and an interply material attached to the roofing material. The interply material is attached adjacent to an edge of the roofing material and is scored to permit a major portion of the interply material to be folded away from the roofing material for application to a roof. The roofing material may be a roofing shingle or roll roofing and the interply material is comprised of a water resistant material.

U.S. Pat. No. 6,936,329 discloses a fastener-free composite roofing product comprising a roofing material and an interply material attached to the roofing material, wherein the interply material includes an adhesive coating on one side. The interply material is attached adjacent to an edge of the roofing material to permit a major portion of the interply material to be folded away from the roofing material for application to a roof. The adhesive is effective to secure the roofing product to the roof without the use of nails or other fasteners. The roofing material may be a roofing shingle or roll roofing, and the interply material is comprised of a water resistant material.

U.S. Pat. No. 6,990,779 discloses a roofing system having a multiplicity of courses of roofing shingles and interply material having at least one course of interply material overlapping at least about ten percent of a first course of shingles and a second course of shingles overlapping at least a portion of the interply material and the first course of shingles. More than about 40% of the first course of shingles is exposed after installation. The roofing system has a class A fire resistant rating. Roofing shingles having particular utility in the roofing system of the present invention are also disclosed. In preferred embodiments the shingles have an exposure width of at least about 60% of the shingle, more preferably at least about 64% of the width of the shingle.

US 20040182032A1 discloses a multi-layer laminate shingle having a base layer and at least a second layer above the base layer. At one end of the shingle the base layer projects beyond the second layer while at the other end the second layer projects beyond the base layer. When the shingles are laid in a course along the roof, the projecting end of the second layer overlaps the projecting end of the base layer of the next shingle, forming a shiplap joint over all or substantially all of the width of the shingle, protecting the joint against rain penetration. This shiplap feature allows the headlap to exposure ratio of the shingle to be reduced to less than 1 and even to 0.5 or less, thus reducing the cost of shingles per unit of roof coverage area. If desired, a narrow strip can be adhered to the top of the headlap portion of the shingle or beneath the butt portion of the shingle to emulate the appearance of a costly triple laminate shingle.

U.S. Pat. No. 4,459,788 discloses a wood shingle panel including an elongated backing sheet and a face layer adhesively bonded together, the face layer being composed of a double course of half-length shingle sections formed by severing standard full-length tapered wood shingles midway between their tip and butt ends. The butt end portions of the tip shingle sections are located adjacent to the lower longitudinal edge of the backing sheet and the tip end portions of the butt shingle sections are located adjacent to the upper longitudinal edge of the backing sheet. The butt end portions of the butt shingle sections are arranged along the central portion of the backing sheet and overlie the tip end portions of the tip shingle sections. The butt end portions of the butt shingle sections are rabbeted for receiving the tip end portions of the tip shingle sections in the rabbet. The lower margin of the backing sheet may be rabbeted beneath the butt portions of the tip shingle sections to overlap the upper margin of the next lower panel.

U.S. Pat. No. 5,094,058 discloses a roofing shingle having a body portion of generally flat, four-sided polygonal configuration and relatively thin in thickness. The body portion is provided with a plurality of irregular corrugations or otherwise deformed to give the roofing shingle the appearance of natural wood or other natural material such as slate. The body portion has a channel formed in the under surface so that the upper surface forms a ridge extending substantially parallel to the upper edge of the body portion. The body portion is also provided adjacent each of the opposite side or vertical edges with raised portions which are so shaped and dimensioned as to have one raised portion nest within the raised portion of a next adjacent like roofing shingle. The ridge and nested raised portions form barriers to water infiltration between the overlapping shingles.

In U.S. Pat. No. 4,731,970 a shingled panel for covering the exterior of structures is disclosed which includes a base sheet having at least one, and preferably multiple courses of shingles secured thereto. The lowest course of shingles are positioned over a water resistant membrane strip having an opening through which the shingles are glued directly to the base sheet. Each higher course of shingles has a membrane strip thereunder which terminates short of the bottom of each shingle in that course so that glue bond between the lower portion of each shingle in that course and the shingles in the next lower course can be achieved. Side-to-side sealing of adjacent panels is effected by the end shingles in alternate courses of shingles extending beyond the edges of the panel, while the end shingles in the same courses at the opposite ends similarly are laterally recessed from the edges of the panel. Moreover, laterally recessed end shingles have a thickness dimension greater than laterally protruding end shingles to facilitate nesting of shingles from laterally adjacent panels in overlapped, side-by-side relation across the joint between adjacent panels.

US 20060059832A1, US 20070094976A1, US 20070151171A1, U.S. Pat. No. 7,448,177 and U.S. Pat. No. 7,454,873 disclose a slate roofing system with reduced dimension slates having an interlayment approach to closing gaps between tiles.

DETAILED DESCRIPTION

In a first aspect, a roofing shingle comprises: a shingle body comprising a buttlap portion with a butt edge and a headlap portion with a head edge, a first side edge and a second side edge, and; a water impermeable sheet adjacent to the shingle body, the sheet having a length and a width, the length extending from the first side edge to the second edge of the shingle body, and the width extending from below the head edge to beyond the head edge of the shingle body, the water impermeable sheet also having an upper edge and a lower edge. The shingle body has an exposure zone extending upwardly from the butt edge toward the headlap portion that is exposed to the environment when the shingle is installed on a roof and provides weather protection and aesthetic effect to the roof. The shingle body also has a fastening zone that is between the exposure zone and the head edge of the shingle body. The width of the headlap portion of the shingle body is less than the width of the exposure zone. The width of the water impermeable sheet extends beyond the head edge of the shingle body such that a first distance between the head edge and the upper edge of the water impermeable sheet is equal to or greater than the width of the exposure zone. The water impermeable sheet extension above the shingle body provides a top lapping structure of a different material from that of the shingle body that closes a shingled roof to water penetration.

In a second aspect, the shingle is as described in first aspect above, wherein, the width of the water impermeable sheet extends approximately to the butt edge of the shingle body, the lower edge of the water impermeable sheet being proximate the butt edge of the shingle body.

In a third aspect, the lower edge of the water impermeable sheet is offset upwardly from the butt edge of the shingle body by an amount less than the width of the exposure zone of the shingle body.

In another aspect the shingle body emulates two or more courses of conventional shingles.

In certain embodiments the top lapping structure includes structural elements that have raised portions that result in moisture diverting pathways to direct any moisture that may enter into the joint between two adjacent shingles or beneath the butt edge of the shingle on a sloped roof in a downward direction so that the roof may drain and not have water enter the building.

In other embodiments, sealants are provided that further close the roof to moisture entrance. In some cases continuous sealants provide a barrier to moisture intrusion. In other cases patterns or structures formed by the sealants provide barriers and drainage pathways to prevent moisture intrusion.

The accompanying drawings will help explain the invention. The drawings are not necessarily to scale, and sizes of various elements can be distorted for clarity.

Figure 1A:
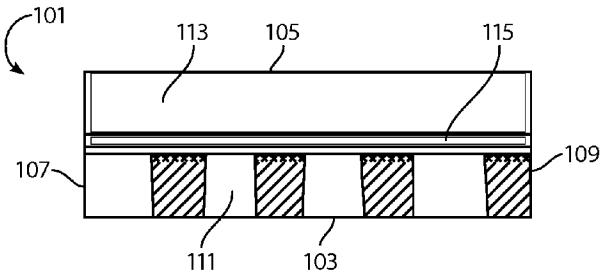
FIGS. 1*a*-1*d* and 2*a*-2*b* are plan views of conventional shingles.
Figure 1B:
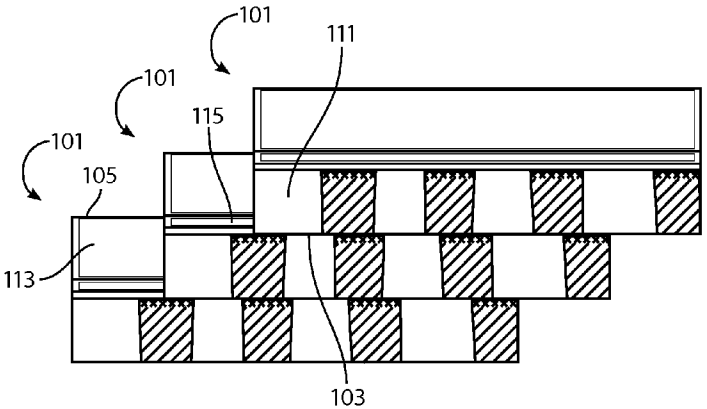

FIG. 1*a* shows a top view of a typical laminated shingle 101. The shingle 101 has a butt edge 103, a head edge 105 and first and second side edges 107, 109, respectively. The exposure zone 111 is adjacent the butt edge 103. The headlap zone 113 is adjacent the head edge 105. The fastening zone 115 is between the exposure zone 111 and the headlap zone 113. FIG. 1*b* shows three such shingles 101 arranged in a laterally offset, partially overlapping array, much as would be the case if the shingles 101 were laid up on a roof. The fastening zone 115 of an underlying shingle is covered by the exposure zone 111 near the butt edge 103 of the shingles of the next overlying course. The headlap zone 113 extends upwardly to the head edge 105 such that an upper portion of the headlap zone 113 near the head edge 105 of a shingle of a first course of shingles is underlying the fastening zone 115 of a shingle of a second course of shingles, and also underlying the lower end of the exposure zone 111 of a shingle of a third course of shingles in the arrangement.

Figure 1C:
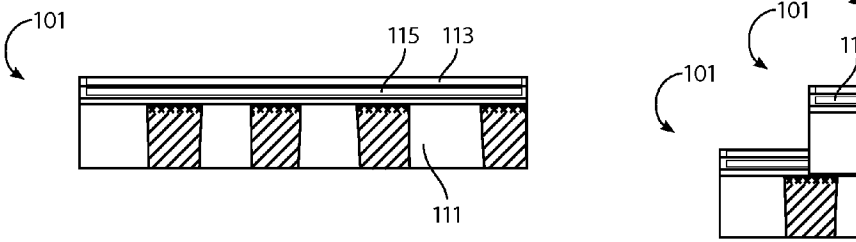
Figure 1D:
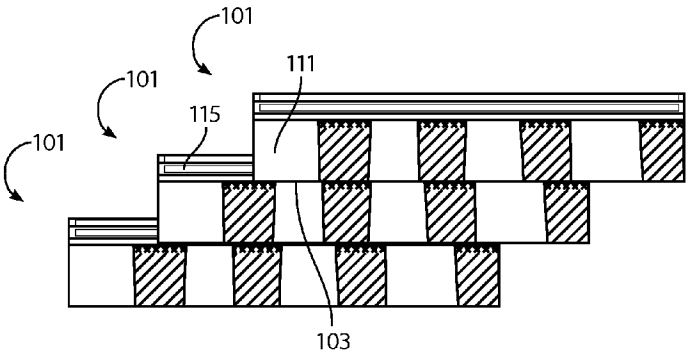

FIG. 1*c* shows a plan view of a similar laminated shingle 101, but with much of the headlap zone 113 omitted. The fastening zone 115 is above the exposure zone 111. FIG. 1*d* shows three such shingles 101 arranged in a laterally offset, partially overlapping array much as would be the case if the shingles 101 were laid up on a roof. The fastening zone 115 of an underlying shingle is covered by the exposure zone 111 near the butt edge 103 of the shingles 101 of the next overlying course.

Figure 2A:
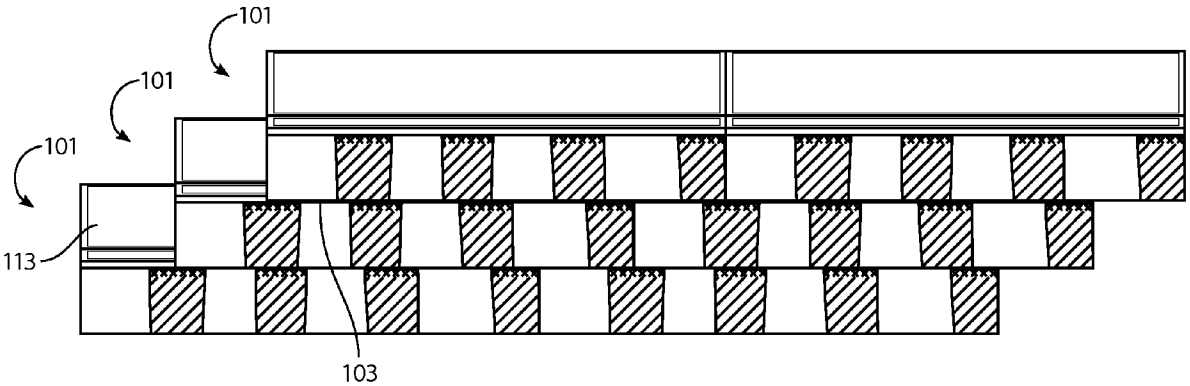
Figure 2B:
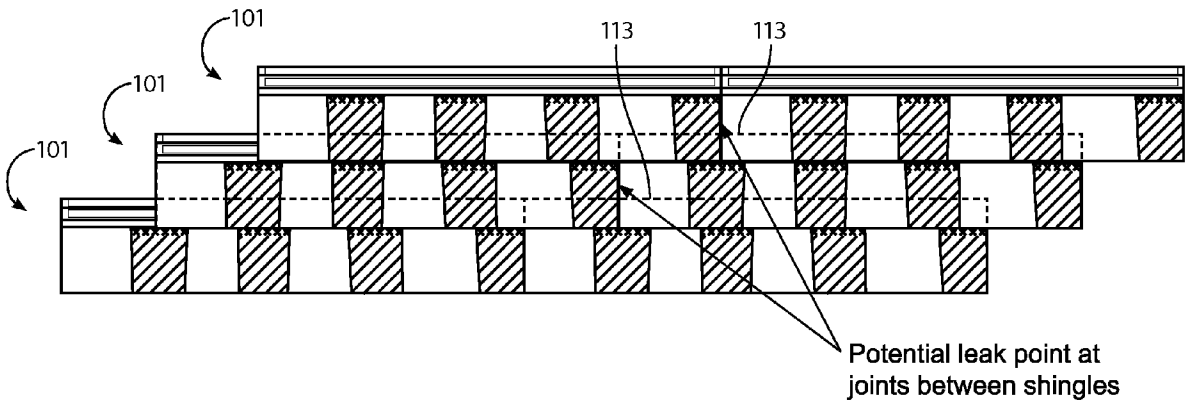

FIG. 2*a* shows two laterally adjacent shingles 101 of FIG. 1*a* arranged in three offset courses as in FIG. 1*b*. FIG. 2*b* similarly shows three courses of pairs of laterally adjacent shingles 101 arrayed as in FIG. 1*d*. In FIG. 2*a*, the headlap zone 113 of the first course extends upwardly beneath the butt edge 103 of the third course. With this arrangement, the joints between adjacent shingles 101 of the second course have the headlap zone 113 of a shingle 101 of the first course underlying the joint so that any water entering the joint will be directed down the roof. Dashed lines in FIG. 2*b* indicate the outline of the underlying shingles 101 in the array. In FIG. 2*b*, it is apparent that the headlap portions 113 of an underlying course of shingles 101 do not extend sufficiently upward to provide closure of the shingled roof in the areas of joints between laterally adjacent shingles 101. Such joints would be a potential leak point in the shingled roof where moisture could enter the joint and not be directed away as is would be the case with conventional shingles 101 as shown in FIG. 2*a*.

Figure 3C:
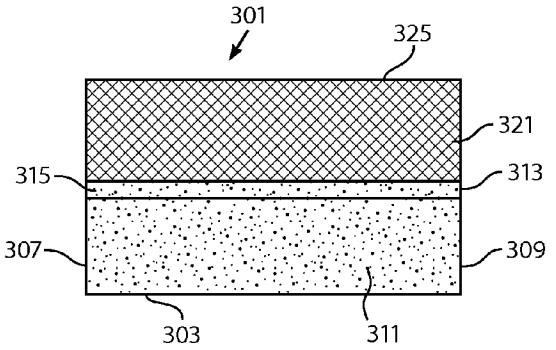
FIGS. 3*a*-3*d*, 4*a*-4*d*, 5*a*-5*f* and 6*a*-6*e* are plan views of various embodiments of shingles.
Figure 3D:
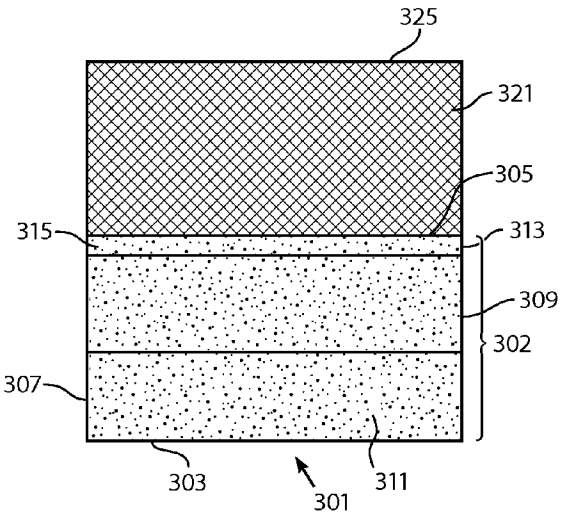
Figure 3A:
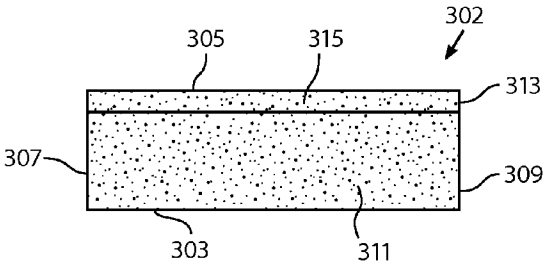
Figure 3B:
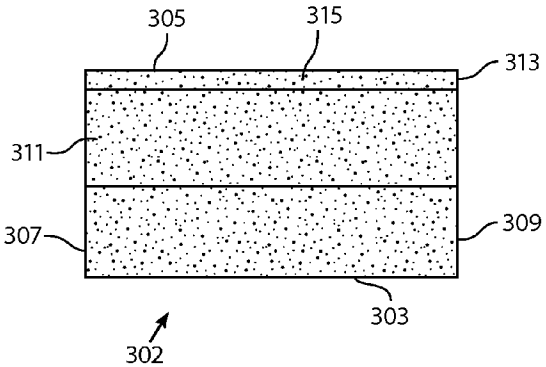

FIG. 3*a* shows a top view of a shingle body 302 with a buttlap portion with a butt edge 303 and a short headlap portion with a head edge 305, a first side edge 307 and a second side edge 309. It is similar to the shingle depicted in FIG. 1*c*, but without aesthetic embellishment so as to suggest that the appearance of the exposure zone could take on any desired appearance. FIG. 3*b* further includes a water impermeable sheet 321 adjacent to the shingle body 302, the sheet 321 having a length and a width, the length extending from the first side edge 307 through the second side edge 309 of the shingle body 302; and the width extending beyond the head edge 305 of the shingle body 302. The shingle body 302 has an exposure zone 311 extending upwardly from the butt edge 303 toward the headlap portion 313 that is exposed to the environment when the shingle 301 is installed on a roof and provides weather protection and aesthetic effect to the roof. The shingle body 302 also has a fastening zone 315 that is between the exposure zone 311 and the head edge 305. In one embodiment, the width of the water impermeable sheet 321 extends beyond the fastening zone 315 by an amount approximately equal to or greater than the width of the exposure zone 311. The water impermeable sheet 321 extension from the shingle 301 provides a top lapping structure that closes a shingled roof to water penetration as shown later. In some cases, the water impermeable sheet 321 has an upper edge 325 that extends beyond the head edge 305 by an amount greater than or equal to a distance from the butt edge 303 of the shingle body 302 to the fastening zone 315. The shingle body 302 of FIG. 3*c* is similar to that of FIG. 3*a*, except that the exposure zone 311 takes on the area of two courses of conventional shingles. The shingle 301 of FIG. 3*d* has an exposure zone 311 for the effect of two courses of shingles and has a water impermeable sheet 321 adjacent to the shingle body 302 with a width extending beyond the head edge 305 of the shingle body 302. The water impermeable sheet 321 extension from the shingle 301 provides a top lapping structure that closes a shingled roof to water penetration and a single shingle provides the effective coverage of two conventional shingles.

Figures 4A, 4B, 4C, 4D:
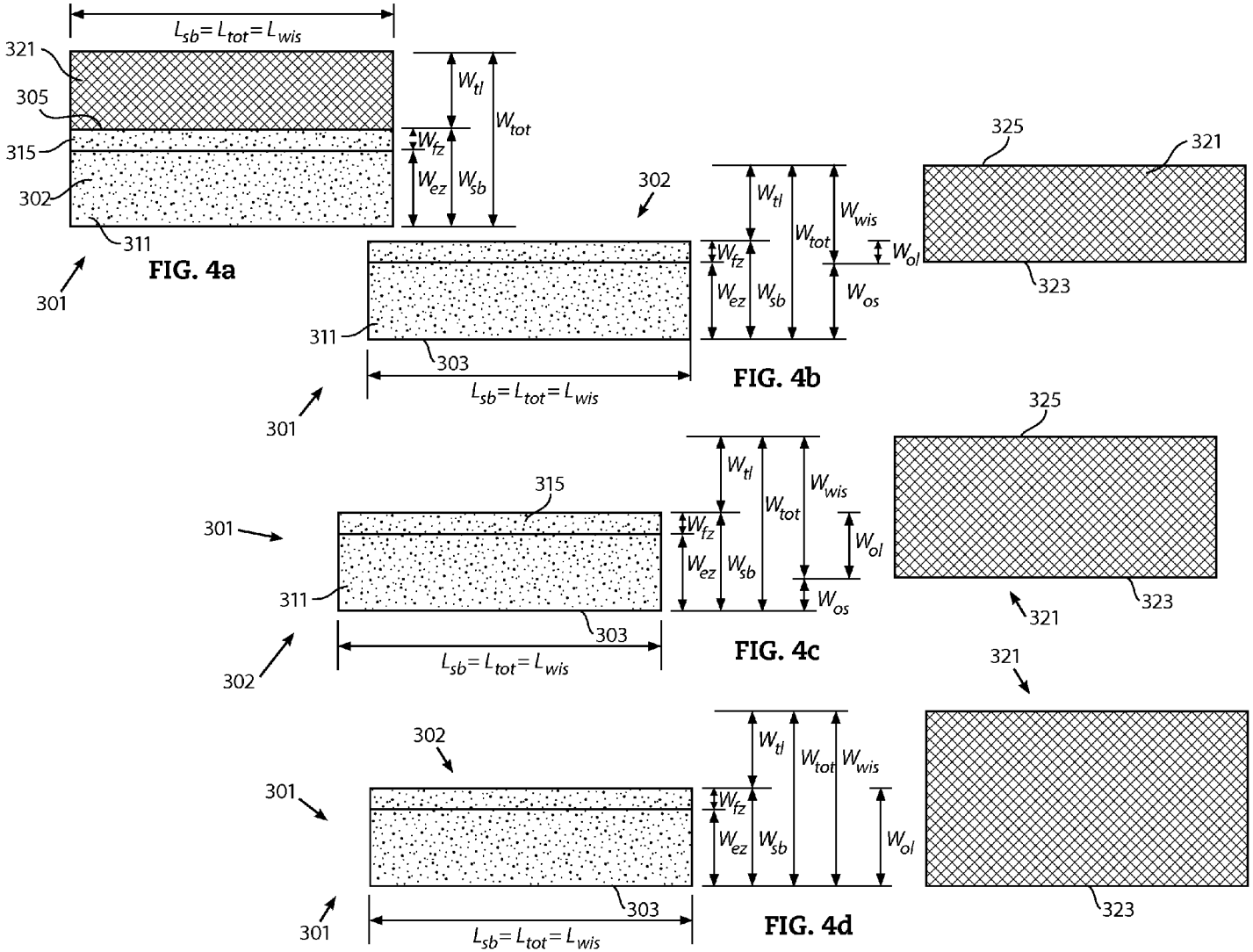

FIG. 4 depicts various alternative embodiments of the shingle 301 of FIG. 3B and relative dimensions of various components of such embodiments. The shingle 301 has a water impermeable sheet 321 that forms a top lap and the water impermeable sheet 321 is attached to the shingle body 302, in this case, on the rear face of the shingle body 302. In an alternative arrangement where the shingle body 302 is a laminated shingle body, the water impermeable sheet 321 may be sandwiched between two layers of the laminated construction at a level farther down in the construction than the front face of the shingle body 302. In yet another alternative embodiment, a portion of the water impermeable sheet 321 may overlap at least a portion of the front face of the shingle body 302. FIG. 4*a* shows an assembled shingle 301, FIGS. 4*b, c* and *d* depicting the shingle 301 separated into shingle body 302 components and water impermeable sheet 321 components.

In FIG. 4*a*, the overall shingle 301 with the water impermeable sheet 321 has a total length $L_{tot}$. The shingle body 302 has a length $L_{sb}$. The water impermeable sheet 321 forms a top lap and has a length of $L_{wis}$. In this case, $L_{sb}=L_{tot}=L_{wis}$. The shingle body 302 also has a width $W_{sb}$, the width including the width of the exposure zone 311 $W_{ez}$ and with width of the fastening zone 315 $W_{fz}$. The width of the water impermeable sheet 321 extends above the head edge 305 to form a top lap structure having a width $W_{tl}$. The total width of the shingle 301 $W_{tot}$ being the sum of $W_{sb}$ and $W_{tl}$.

The shingle 301 of FIG. 4*b* has a water impermeable sheet 321 with a width that is substantially similar to that of the shingle body 321 such that $W_{wis}\approx W_{sb}$. The lower edge 323 of the water impermeable sheet 321 is offset from the butt edge 303 of the shingle body 302 by an offset $W_{os}$ and has an overlap with the shingle body 302 of $W_{ol}$. In one embodiment where the water impermeable sheet 321 and the shingle body 302 have about the same width, the offset $W_{os}$ is about the same as the width of the top lap $W_{tl}$. In another embodiment, the offset $W_{os}$ is equal to or greater than the width of the exposure zone 311 $W_{ez}$ while retaining sufficient overlap $W_{ol}$ to attach the water impermeable sheet 321 to the shingle body 302. When the water impermeable sheet 321 is attached to the shingle body 302, the sheet 321 provides a closure point for the roof and directing any water entering a joint between adjacent shingle bodies 302 downwardly along the roof.

The shingle 301 of FIG. 4*c* has a water impermeable sheet 321 with a width that is greater than that of the shingle body 302 such that $W_{wis}>W_{sb}$. The water impermeable sheet 321 extends downwardly by an overlap $W_{ol}$ of greater than the width of the fastening zone 315 $W_{fz}$, but less than the width of the shingle body 302 $W_{sb}$. The water impermeable sheet 321 provides a top lap of width $W_{tl}$ that, in the installed state, is beneath the joint between laterally adjacent shingle bodies 302, thus providing a closure point for the roof and directing any water entering a joint between adjacent shingle bodies 302 downwardly along the roof. In this case, the offset $W_{os}$ is less than the width of the exposure zone 311 $W_{ez}$.

The shingle 301 of FIG. 4*d* has a water impermeable sheet 321 with a width that is greater than that of the shingle body 302 such that $W_{wis}>W_{sb}$ and the water impermeable sheet 321 extends downwardly to the butt edge 303 of the shingle body 302. In this case, the total width of the shingle 301 including both top lap and shingle body 302 is that same as the width of the water impermeable sheet 321, $W_{tot}=W_{wis}=W_{tl}+W_{sb}$ and the width of overlap $W_{ol}$ is the same as the width of the shingle body 302 $W_{sb}$. The water impermeable sheet 321 provides a top lap of length $W_{tl}$ that, in the installed state, is beneath the joint between laterally adjacent shingles 301 of a first overlying course with a portion of the water impermeable sheet 321 extending upwardly behind the butt edge 303 of shingle bodies 302 of a second overlying course, thus providing a closure point for the roof and directing any water entering a joint between adjacent shingle bodies 302 downwardly along the roof.

It is generally desirable that the width of the top lap $W_{tl}$ is such that the total width of the shingle $W_{tot}$ is at least about 2 inches greater than twice the width of the exposure zone $W_{ez}$. In one case, where the fastening zone width $W_{fz}$ is about 2 inches, $W_{tl}$ is about the same as the width of the exposure zone $W_{ez}$. In other cases $W_{tl}$ is greater than the width of the exposure zone $W_{ez}$. In the case where the fastening zone width $W_{fz}$ includes additional extension into the headlap, $W_{tl}$ can be less than $W_{ez}$.

Figure 5A:
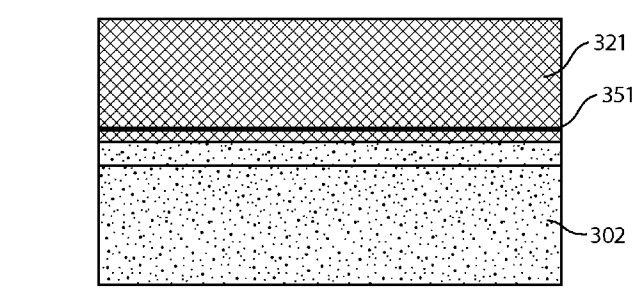
Figure 5B:
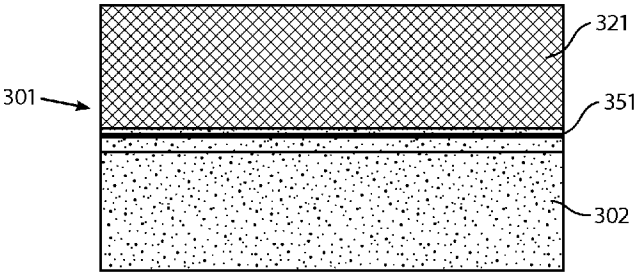
Figure 5C:
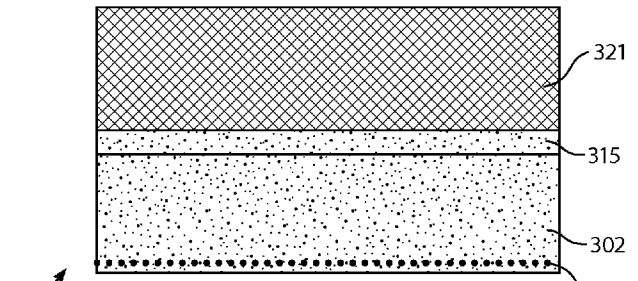
Figure 5D:
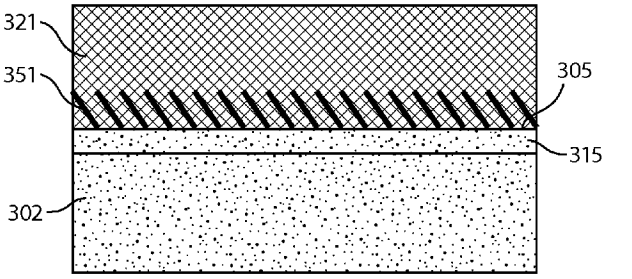
Figure 5E:
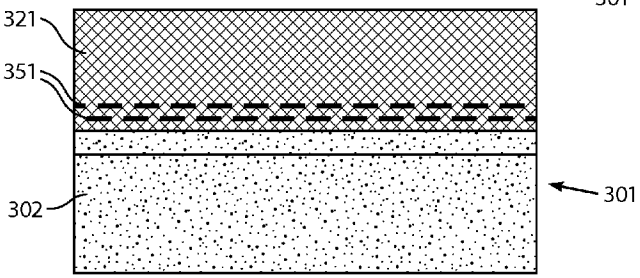
Figure 5F:
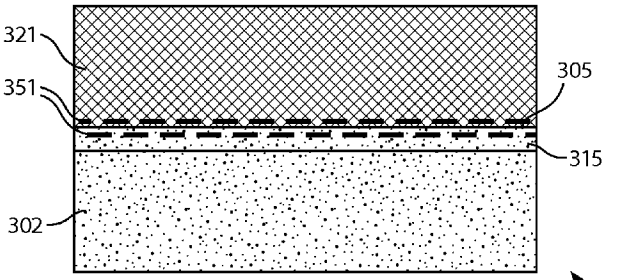

Sealants can also be employed with the top lap to enhance closure of the roof. FIG. 5*a* shows a continuous line of sealant 351 on the top surface of the top lap 321 near the shingle body 302 that will form a bond with the back surface of an overlying shingle 301, further closing the roof and providing a path directing downward travel of any moisture that may enter the joint between adjacent shingles 301. A second or more line of sealant 351 may also be employed (not shown) as a backup sealant. In FIG. 5*b*, a continuous line of sealant 351 is provided on the top of the shingle body 302 adjacent the head edge 305 above the fastening area 315. FIG. 5*c* shows (in phantom) a sealant line 351 on the back surface of the shingle 301 near the butt edge 303 of the shingle 301 opposite that of the top lap portion. Such a sealant 351 forms a bond between the back of the shingle 301 and the top surface of the upper edge portion 315 of an underlying installed shingle 301. One or more of the sealant lines 351 may be continuous or discontinuous. FIG. 5*d* shows an alternative sealant arrangement where lines of sealant 351 are arranged in a chevron-like pattern so that there are no direct upward paths for intruding water. The sealant lines 351 are arranged so that they direct any water downwardly along the roof. FIG. 5*e* shows a pair of sealant lines 351 in a discontinuous configuration with the adjacent lines of sealant being laterally offset so that a direct upward path for water is avoided. FIG. 5*f* shows an alternative disposition of a pair of discontinuous sealant lines 351 having lateral offsets of the discontinuities where one of the sealant lines 351 is on the surface of the top lap material of the water impermeable sheet 321 and the other sealant line 351 is on the top surface near the head edge 305 of the shingle body.

It will be understood that other sealants may also be employed in other locations on the shingle such as on top of the shingle body in or near the fastening zone so that a seal is formed between the top surface of the shingle and the bottom surface of an overlying shingle. Sealants can also be employed on the bottom surface of the shingle in the vicinity of the butt edge of the shingle so that a bond can be formed between the bottom surface of the shingle and the top surface of an underlying shingle. Various sealant arrangements can also include sealants on the top of a shingle near the fastening zone and on the bottom of a shingle near the butt edge on the same shingle. Sealants can be arranged so that in an installed state, the sealant lines match and adhere to one another, or alternatively, sealant lines can be arranged to adhere to the other shingle in a complementary location so as to provide an enhanced bond between the shingles. Still other embodiments may include aspects disclosed in U.S. Pat. Pub. 2011/0061326, which is incorporated herein by reference in its entirety.

Figure 6D:
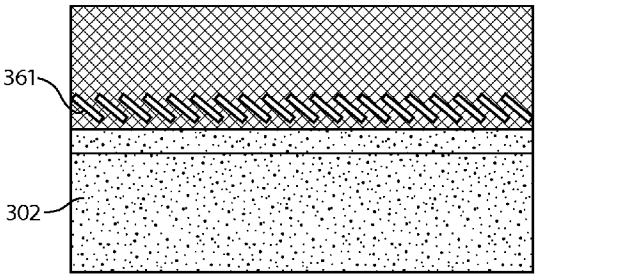
Figure 6E:
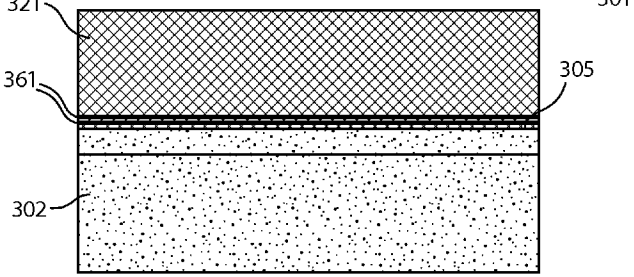
Figure 6A:
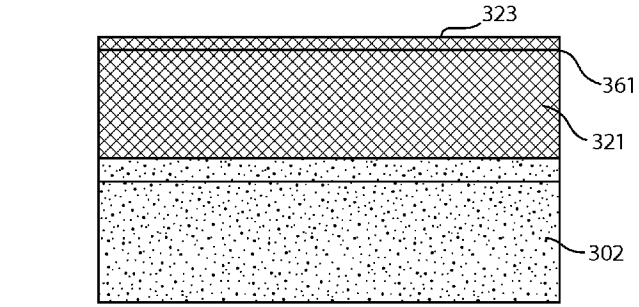
Figure 6B:
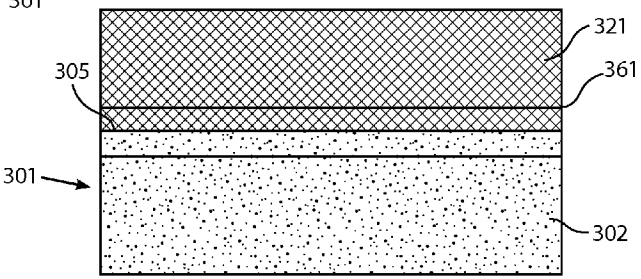
Figure 6C:
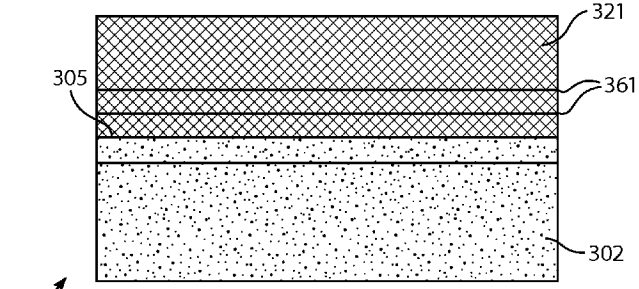

Mechanical structures can also be provided to the top lap portion to assist in directing water down a roof in the event that it may enter a joint between adjacent shingles or beneath the butt edge of a shingle. FIG. 6 shows top schematic views of a number of such treatments. FIG. 6*a* shows a top lap 321 attached to a shingle body 302 having a raised ridge 361 near the upper edge 325 of the water impermeable sheet 321. In FIG. 6*b* the top lap 321 is provided with a raised feature 361 near the lower edge of the top lap area 321 above the head edge 305 of the shingle body 302. The feature is generally parallel to the head edge 305 of the shingle body 302 and spaced at least slightly away from the head edge 305 of the shingle body 302. FIG. 6*c* shows another top lap embodiment where a second raised feature 361 is provided as a redundancy in case water were able to find its way over the first such structure 361 there would be a second barrier 361. FIG. 6*d* shows another embodiment where a plurality of raised features 361 are arranged in a series of chevron-like structures prevention a direct path upwardly under an overlying shingle 301. FIG. 6*e* shows a wider raised feature 361 near the lower edge of the top lap 321 in the vicinity of the head edge 305 of the shingle body 302.

Figures 7A, 7B, 7C, 7D, 7E, 7F, 7G, 7H, 7I, 7J:
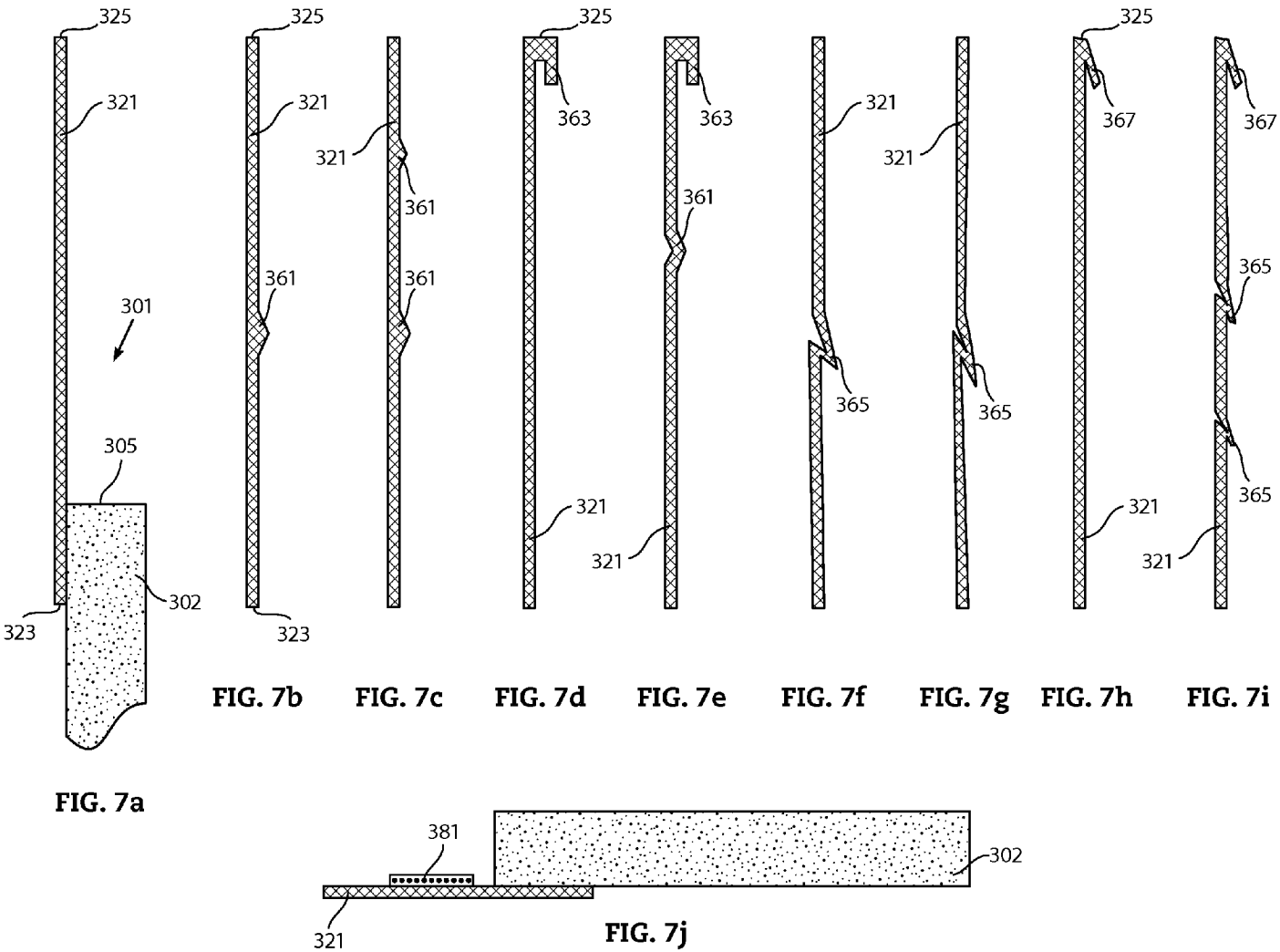
FIGS. 7*a*-7*j* and 8*a*-8*k* are side and plan views of alternate embodiments of shingles.

In FIG. 7, side edge schematic views of a number of raised structure configurations 361 on the top lap portion of the shingle 301 made up of the water impermeable sheet 321. FIG. 7*a* shows a water impermeable sheet 321 attached to a shingle body 302 near the head edge 305 of the shingle body 302. It will be understood that the attachment to the shingle body 302 may be on the front or rear surface of the shingle body 302, or, in some embodiments, may be an internal attachment between two layers of a laminated shingle body structure. The top lap structure of FIG. 7*a* does not have a raised structure and is substantially planar. It will be further understood that the surfaces of the water impermeable sheet 321 may carry a texture. FIGS. 7*b* through 7*i* show alternative arrangements of water impermeable sheets 321 with the shingle body 302 not shown.

The water impermeable sheet 321 of FIG. 7*b* has a raised feature 361 disposed between the upper and lower edges 325, 323 of the sheet 321 wherein additional material of the same or different constitution is provided to yield a barrier to upwardly directed moisture beneath a shingle body 302. In one aspect, the raised structure 361 is a ridge that traverses the length of the top lap. In another alternative, the raised feature 361 can take on a different shape, such as, for example that the feature 361 of FIG. 6*d*, that of the sealant configuration 351 of FIG. 53, or the like. In FIG. 7*c*, the top lap has two such structures 361.

In FIG. 7*d*, the upper edge 325 of the top lap has a folded over inverted J-shaped flange 363 to prevent water from traveling upward beneath and overlying shingle course. The top lap of FIG. 7*e* also has such a J-shaped flange 363, but further has a raised ridge feature 361 that is formed by a crimped structure such that no additional material is needed to create the ridge.

FIG. 7*f* shows an alternative configuration of a raised feature 365 formed by crimping the water impermeable sheet material 321 and directing the raised shape downward so that water intrusion upward would be blocked by the feature, and, if water would somehow find its way above the feature 365, the path back downward would be sloped so as to allow drainage of the roof over the feature. FIG. 7*g* shows a raised feature 365 generated by a pleated structure where the top lap material 321 is crimped and folded back down on itself as a moisture block. In FIG. 7*h*, the upper edge 325 of the sheet material is folded forward and downward to yield a blocking structure 327 similar to the J-shaped structure 363 of FIG. 7*d*. The top lap of FIG. 7*i* has both a folded down upper edge 367 and two pleated raised structures 365 to minimize moisture intrusion.

FIG. 7*j* depicts an alternate embodiment having an additional asphalt portion or component 381 (i.e., separate from the shingle body 302) formed on an upper surface of the water impermeable sheet 321. This component 381 may be spaced apart from the shingle body 302 as shown, and may be used to help properly align and orient the sheet 321 with the shingle body 302 during manufacturing. In addition, this component 381 may be used as an alignment feature for adjacent and/or abutting shingles 301. It will be understood that the top lap of the water impermeable sheet 321 may have any combination of one or more of the above described mechanical structures and sealant arrangements disposed thereupon.

Figures 8A, 8B, 8C, 8D, 8E, 8F, 8G, 8H, 8I, 8J, 8K:
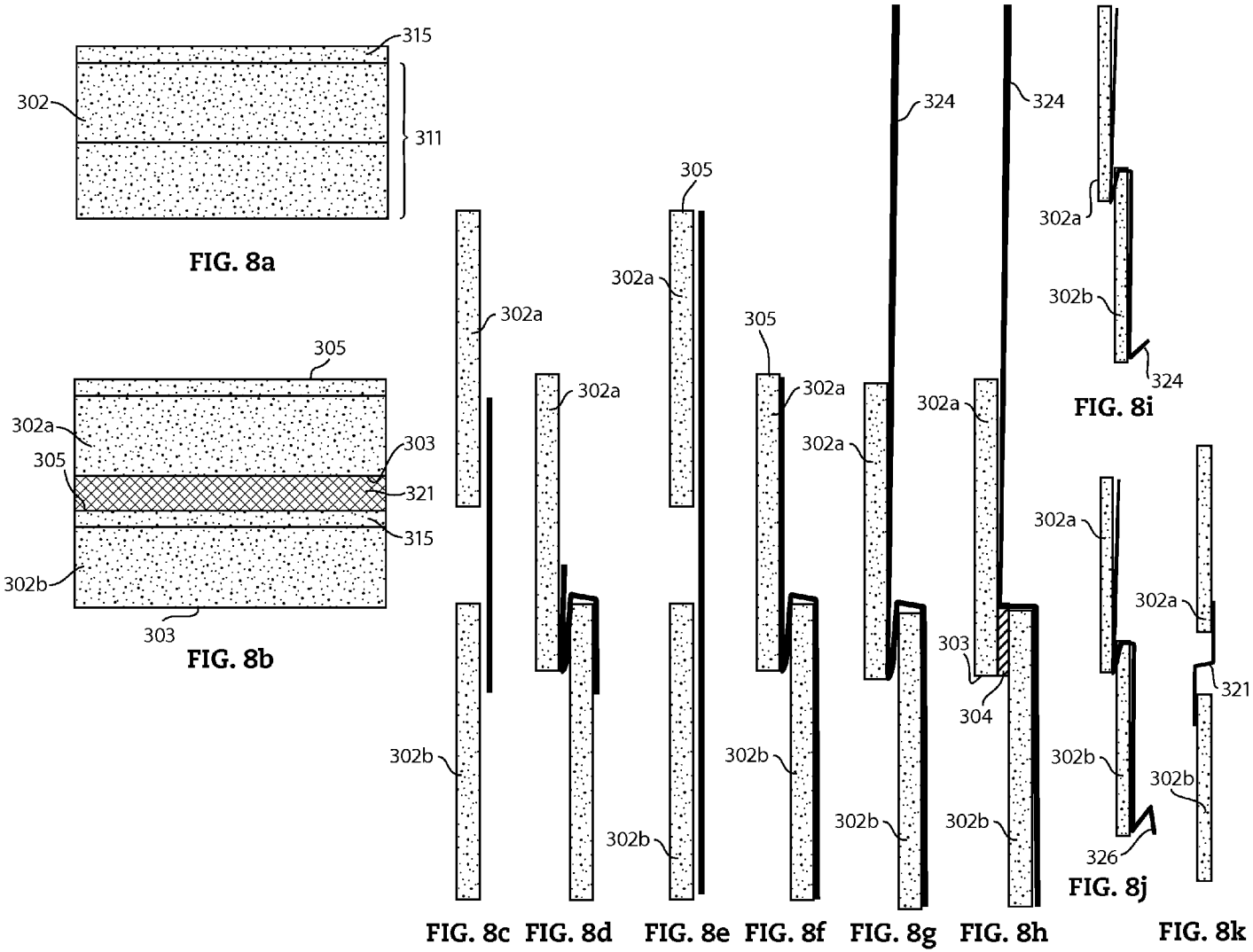

In some embodiments the shingle body is provided with a more than one course exposure zone relative to conventional shingles. FIG. 8*a* shows a shingle body 302 having a double exposure zone 311 and a fastening zone 315. In one aspect the larger format shingle body is provided by attaching the two courses 302*a*, 302*b* to one another with an appropriate adhesive 304 as depicted in the side edge view of FIG. 8*h*, where an adhesive 304 is located in what would be the fastening zone 315 of the lower course shingle 302*b* that attaches the lower shingle 302*b* to lower butt end 303 of the upper course shingle 302*a* so that a shingle 301 comparable to two courses results. In the case of FIG. 8*h*, the water impermeable sheet 321 extends fully to the butt edge 303 of the lower course shingle body 302*b*.

FIG. 8*b* shows an embodiment where a pair of shingle bodies 302*a*, 302*b* is arranged one shingle body above the other and a foldable water impermeable sheet 321 or structure connects the two shingle bodies 302*a*, 302*b*. The water impermeable sheet 302 is attached to the back of the lower portion near the butt edge 303 of the upper shingle body 302*a* and the back of the upper portion near the head edge 305 of the lower shingle body 302*b* in FIG. 8*c*. The foldable, and in some cases flexible, sheet 321 allows the upper shingle 302*a* to be brought forward and down so that the butt end 303 of the upper shingle body 302*a* overlies the fastening zone 315 of the lower shingle 302*b* to present a two course exposure shingle 301 as depicted in FIG. 8*d*. Such a foldable aspect of the connector sheet 321 in this embodiment allows the lower shingle body 302*b* of the dual course shingle to be securely fastened to the roof via its fastening zone 315 prior to bringing the upper course shingle body 302*a* down and into place. The connector sheet 321 prevents moisture intrusion between the upper and lower shingle bodies 302*a*, 302*b* of the dual course shingle 301. An optional sealant (not shown) may be employed to further secure the upper and lower shingle bodies 302*a*, 302*b*. Such a sealant may be provided on the connector sheet 321 so that when folded in place, the sealant engages the fastening zone 315 of the lower shingle body 302*b*. Alternatively, the optional sealant may be provided in the fastening zone 315 of the lower shingle body 302*b* so that when the upper shingle body 302*a* is brought into position the sealant assists in securing it in place in addition to fasteners through the fastening zone 315 of the upper shingle body 302*a* holding the shingle 301 in place on the roof. FIGS. 8*e* and 8*f* show a similar shingle 301 where the connector sheet 321 extends upwardly to proximate the head edge 305 of the upper shingle body 302*a* and downwardly to proximate the butt edge 303 of the lower shingle body 302*b*. FIG. 8*i* is similar to 8*f*, but further includes an upwardly directed extension 324 of the sheet 321 proximate the butt edge 303 of the lower shingle body 302*b*. FIG. 8*j* includes an upward and downward extension 326. The lower extension 324 of the water impermeable sheet 321 folds back to provide blockage to water. In one aspect of this embodiment with particular reference to FIG. 8*i*, the lower extension 324 also serves as an attachment means where by during installation, the shingle 301 is presented face down on the roof with the lower extension 324 aligned with the fastening zone 315 of the underlying already installed course of shingles 301. A fastener is applied through the extension 324 and into the fastening zone 315 of the underlying shingle 301 and the shingle 301 is folded to an upwardly facing position and the shingle 301 is further fastened in place via its fastening zone 315. A roofing shingle 301, having a nail down strip attached to a main portion by flexible strip and attached to roof decking, where the main portion part is folded up and over the nail down strip, and the nail down strip is integral portion of shingle is disclosed in US patent application 2006/0201094A1. The shingle of 8*j* has a further downward fold 326 of the lower extension of the water impermeable sheet 321 that may further serve to block water intrusion beneath the installed shingles. It will be understood that the shingles 301 of FIG. 8 are also equipped with a water impermeable sheet top lap portion 321 (not shown in 8*c*, 8*d*, 8*e*, 8*f*, 8*i* or 8*j*) for ensuring closure of the roof structure on installation. In some embodiments of FIG. 8*g*, the top lap sheet 321 comprises the same sheet as the connector sheet 321. In some embodiments of FIGS. 8*a* through 8*j*, the water impermeable sheet 321 that makes up the top lap of the finished shingle 301 is different in construction from the connector sheet 321.

It will be understood that the portion of the water impermeable sheet 321 may extend beneath the shingle body 302 as described above with reference to FIG. 4. Further, the water impermeable sheet 321 may include a reinforcement so that a level of improved wind resistance and/or impact resistance is provided as described in U.S. Pat. No. 7,537,820 and its patent family. In one embodiment the reinforcement is a part of the water impermeable sheet 321 itself. In another embodiment the reinforcement is made up of an additional sheet built into the roofing product construction. For example, in an embodiment where the water impermeable sheet top lap portion 321 extends behind the head edge 305 of the shingle body 302 for attachment as in the case where length $W_{wis}$ is sufficiently greater than length $W_{tl}$, and $W_{wis}<W_{sb}$, so that it enables attachment to the shingle body 302, a reinforcement is provided to the shingle body 302 having a width comparable to $W_{sb}$.

Figure 9A:
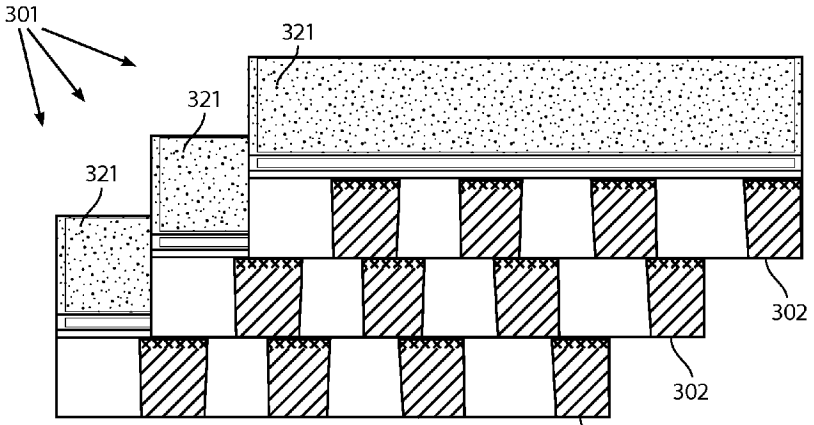
FIGS. 9*a*-9*b* are plan views depicting installation of courses of embodiments of shingles.
Figure 9B:
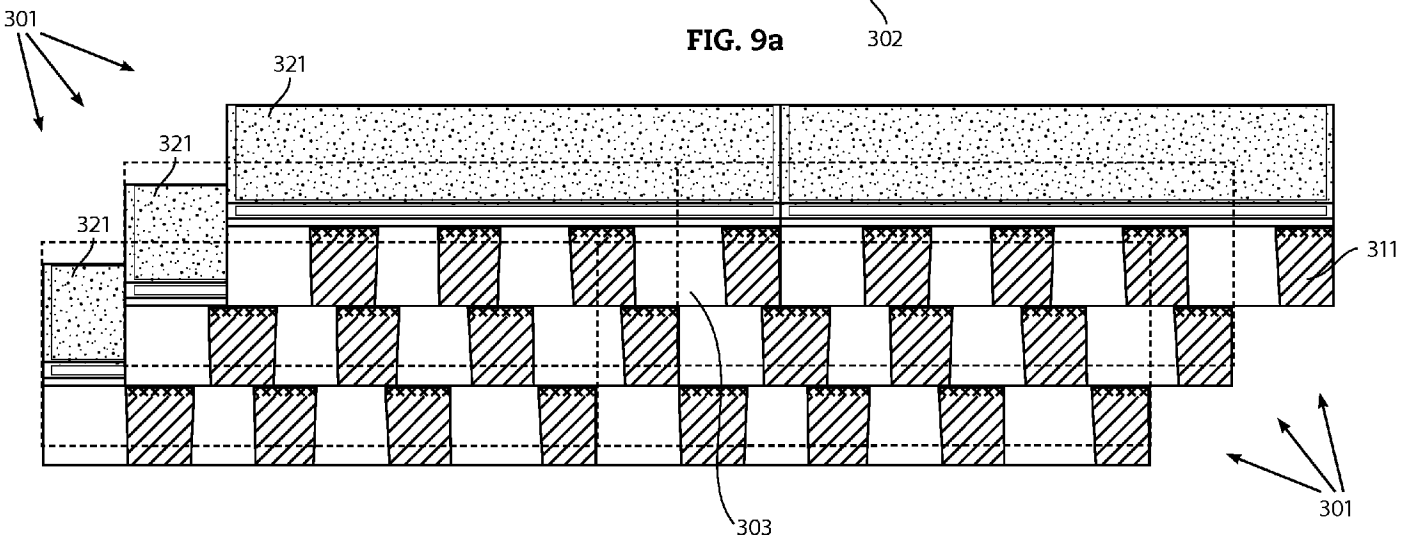

FIG. 9*a* shows three shingles 301 of FIG. 3*b* having shingle bodies 302 with an aesthetic look similar to that of the shingle FIG. 1*c* with removed headlap material, and water impermeable sheet top lap portions 321 arranged in overlapping shingle fashion with a lateral offset as they may be installed upon a roof. FIG. 9*b* shows an additional set of three such shingles 301 arranged so that there are three courses of two shingles 301, the courses being laterally offset from one another and the top lap portions 321 of the shingles 301 in a given course being overlaid by the exposure zone 311 of the first overlying course of shingles 301 and also being overlaid by the butt edge 303 of the second overlying course of shingles 301. FIG. 9*b* shows in phantom the parts of the underlying portions of the shingles 301 that are not exposed. The top lap portion 321 is seen to provide coverage to the roof under the joints between adjacent shingle bodies 302 such that any moisture intrusion between the joints would be directed down the roof and the roof would be closed.

Figure 10A:
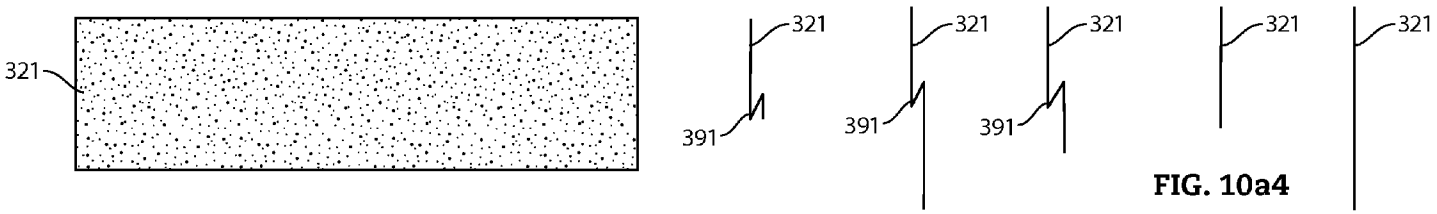
FIGS. 10*a*-10*s* and 11*a*-11*e* are plan and side views of alternate embodiments of shingles.
Figure 10B:
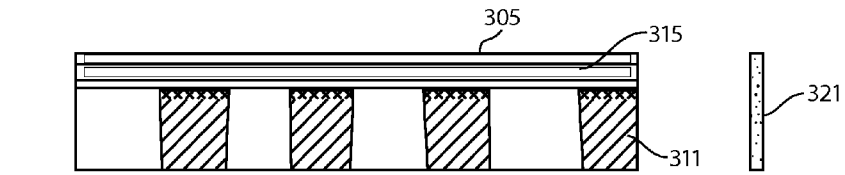
Figure 10C:
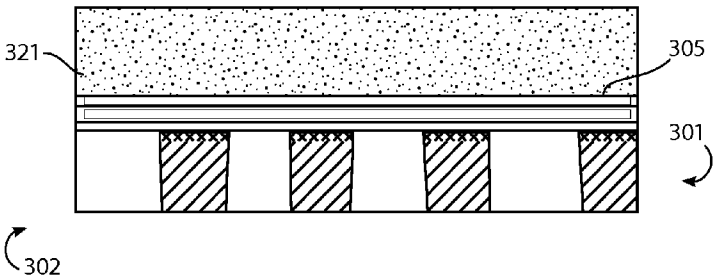

FIGS. 10*a* and 10*b* show components for a shingle 301 including a water impermeable sheet top lap portion 321 and a laminated shingle body 302 having a fastening zone 315 and an exposure zone 311. FIG. 10*c* shows such a shingle 301 assembled. In some embodiments, as described above, the water impermeable sheet 321 may be located near a head edge 305 of the shingle body 302, extend downward from the edge 305 and terminate not far from the head edge 305 of the shingle body 302 near its attachment thereto. Optionally the top lap portion water impermeable sheet 321 may be present well lower than the head edge 305 behind the shingle body 302, even in some instances having a width that allows it to cover the entire back of the shingle body 302 or longer, having a length equal to $W_{to}$, for the shingle. FIGS. 10*a*1, 10*a*2, 10*a*3, 10*a*4 and 10*a*5 show side edge schematic views of various configurations of a water impermeable sheet 321 and FIG. 10*b*1 shows a side edge schematic view of a shingle body 302. FIG. 10*a*1 shows a z-fold arrangement 391 of the sheet 321 where the open downward facing portion of the z-shape in the figure receives the head edge 305 of the shingle body 302. FIG. 10*a*2 shows an alternative z-shape 391 where the sheet 321 includes sufficient material so that its width extends downwardly to the butt edge 303 of the shingle body 302 when the shingle 301 is assembled. FIG. 10*a*3 shows a side edge view of the sheet 321 where the sheet 321 extends partially down the back of the shingle body 302. FIG. 10*a*4 shows a simple flat sheet structure 321 of sufficient width to allow attachment to either the front or the back of the shingle body 302 near the head edge 305 of the shingle body 302. FIG. 10*a*5 shows a sheet 321 of sufficient width to extend downward toward the butt edge 303 of the shingle body 302 when assembled.

Figures 10D, 10E, 10F, 10G, 10H, 10I, 10J, 10K:
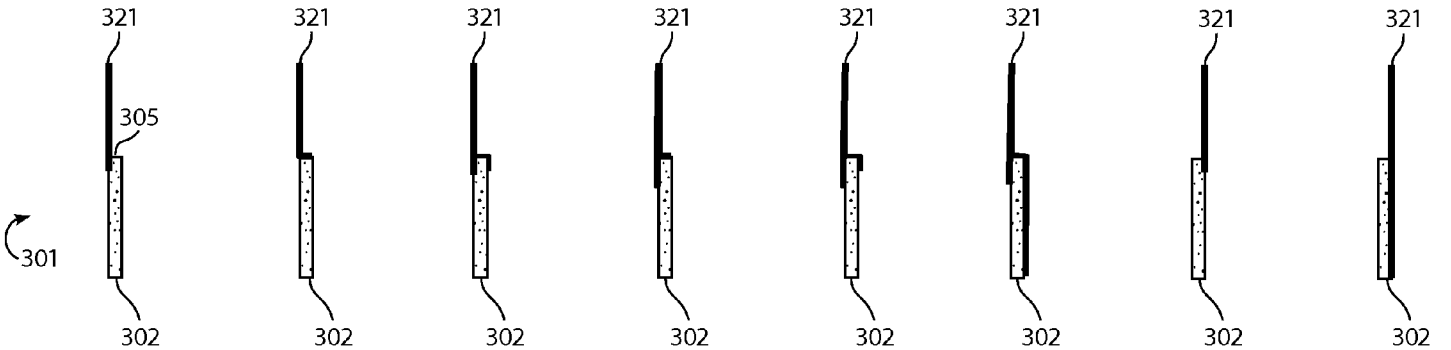
Figures 10L, 10M, 10N, 10O, 10P, 10Q, 10R, 10S:
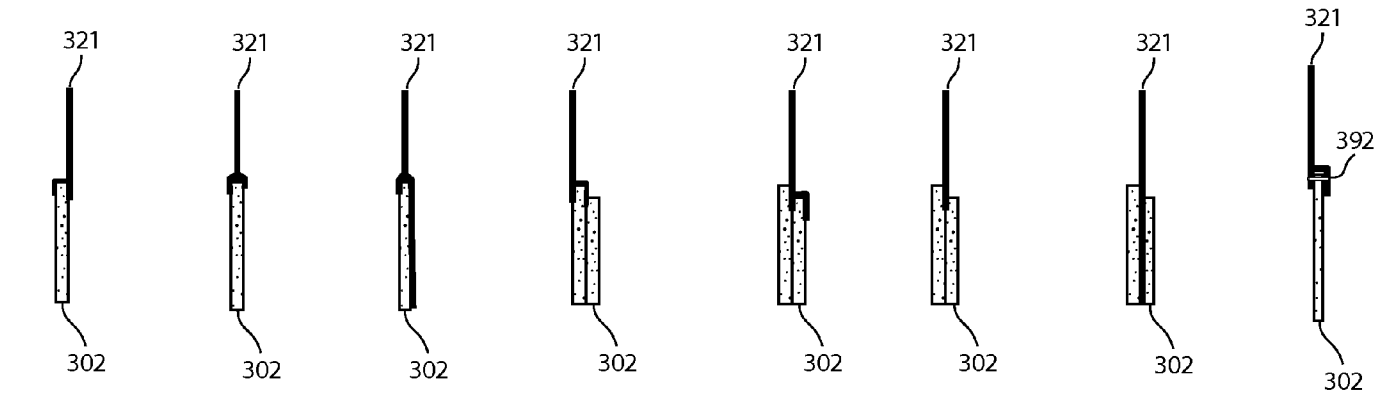

FIGS. 10*d* through 10*r* depict side edge views of various arrangements of water impermeable sheets 321 and shingle bodies 302 in assembled shingles. In FIGS. 10*d* through 10*i*, the water impermeable sheet 321 is disposed close to substantially the same plane as the front surface of the shingle body 302. In FIG. 10*d* the water impermeable sheet 321 is attached to the front face of the shingle body 302 near the head edge 305. The shingle 301 of FIG. 10*e* has the sheet 321 attached to the head edge 305 of the shingle body 302. The shingle 301 of FIG. 10*f* has a receiver portion of the water impermeable sheet 321 attached to the head edge 305 of the shingle body 302 with a portion extending onto the front face of the shingle body 302 near the head edge 305 and another portion extending onto the rear of the shingle body 302 near the head edge 305. The shingle 301 of FIG. 10*g* has an extension of the sheet 321 that covers the fastening zone 315 of the shingle body 302 and a portion attached to the head edge 305 of the shingle body 302. In FIG. 10*h*, the sheet 321 also has a portion to receive the shingle body 302 that wraps around to the rear surface of the shingle body 302 near the upper edge 305. In the shingle 301 of FIG. 10*i*, the sheet 321 extends down to the butt edge 303 of the shingle body 302 on the rear of the shingle 301.

In FIGS. 10*j*, 10*k* and 10*l*, the water impermeable sheet 321 is disposed close to substantially the same plane as the rear surface of the shingle body 302. In FIG. 10*j* the water impermeable sheet 321 is attached to the rear surface of the shingle body 302 near the head edge 305. In the shingle 301 of FIG. 10*k*, the sheet 321 extends down to the butt edge 303 of the shingle body 302 on the rear of the shingle 301. The shingle 301 of FIG. 10*l* has a receiver portion of the water impermeable sheet 321 attached to the head edge 305 of the shingle body 302 with a portion extending onto the rear of the shingle body 302 near the head edge 305 and another portion extending around the head edge 305 and onto the front face of the shingle body 302 near the head edge 305.

The shingles 301 of FIGS. 10*m* and 10*n* have the water impermeable sheet 321 disposed in a plane that is intermediate between the planes of the front and rear surfaces of the shingle body 302. In FIG. 10*m* the shingle 301 is attached at the head edge 305 with portions extending around the head edge 305 to the upper portion of the front and rear faces of the shingle body 302. In the case of the shingle 301 of FIG. 10*n*, the sheet 321 extends downwardly toward the butt edge 303 of the shingle body 302.

FIGS. 10*o*, 10*p*, 10*q* and 10*r* depict embodiments where the shingle body 302 is of laminate structure and at least a portion of the water impermeable sheet 321 is attached to the shingle body 302 between two parts of the laminate structure. In FIG. 10*o*, the sheet 321 is near the plane of the front surface of the shingle body 302 with portions extending to the front surface near the head edge 305 and portions wrapping around the head edge 305 of the front most layer of the laminate structure and between the lamina near the head edge 305 of the shingle body 302. In FIG. 10*p*, a shingle 301 is depicted with the sheet 321 attached to the head edge 305 of the rear layer of the laminated shingle body 302 with a portion extending between the upper edges of the layers near the head edge 305 and the sheet 321 aligned in a plane between the to layers of the laminated shingle body 302. In FIG. 10*q*, the shingle 301 has the water impermeable sheet 321 attached between the upper edges of the laminated shingle body 302. In FIG. 10*r*, the water impermeable sheet 321 is disposed between the layers of the laminated shingle body 302 and extends downwardly to the butt edge 303 of the shingle 301.

It will be understood that a variety of approaches may be used to bond or adhere the top lap material to the shingle body including adhesives, sealants, welds, or the like. Mechanical fasteners are also useful for affixing the water impermeable sheet to the shingle body. FIG. 10*s* shows a shingle 301 similar to that of FIG. 10*f*, but having a mechanical fastener 392 cooperatively engaged with both the top lap material 321 and shingle body 302 at the point of joining.

In one aspect the water impermeable sheet is constituted of a material and is attached to the shingle body in a manner such that it remains substantially in the general plane of the shingle during handling and installation. In another aspect, the sheet is foldable such that it may be folded forward toward the front surface of the shingle body, for example for packaging or shipping in more compact form. In yet another aspect the sheet may be folded backwardly toward the rear of the shingle.

Figure 11E:
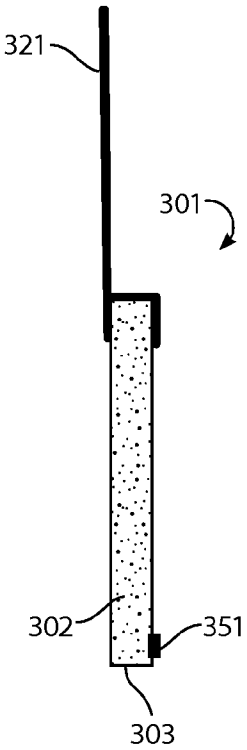
Figure 11D:
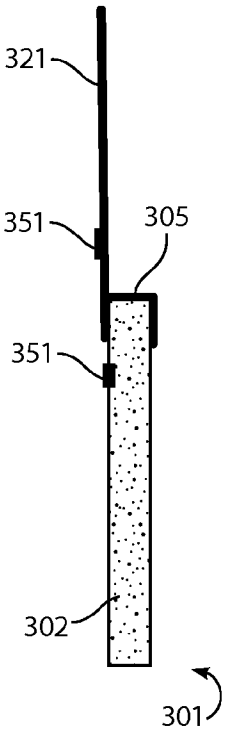
Figure 11C:
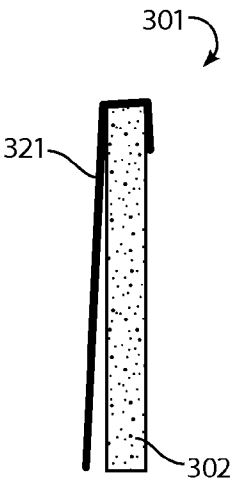
Figure 11B:
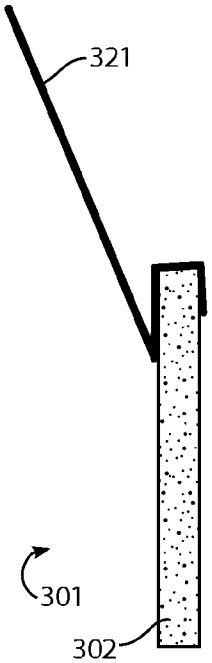
Figure 11A:
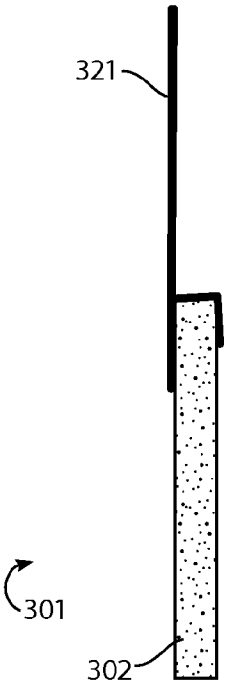

FIG. 11*a* depicts side edge schematic view of a shingle 301 similar to that shown in FIG. 10*h* where the top lap portion 321 is foldable forward toward the face of the shingle 301. FIG. 11*b* shows the top lap 321 partially folded forward, and FIG. 11*c* shows the top lap 321 folded mostly forward to almost the point of contact with the front face of the shingle body 302.

FIG. 11*d* shows a side edge view of a shingle 301 like that of FIG. 10*f*, with additional sealants 351 disposed near the lower edge of the front surface of the top lap of water impermeable sheet material 321 and near the upper edge 305 of the shingle body 302. In one embodiment of a shingle 301 having a foldable top lap sheet 321 and a line of sealant 351 thereon, a release tape is provided on the front surface of the shingle body 302 where the sealant 351 would otherwise meet the shingle surface when folded to prevent blocking of the folded top lap 321 in place. Alternatively, if the sealant 351 is on the shingle body 302, a release strip may be incorporated into the top lap construction to meet the sealant 351 to prevent blocking during storage or transport, yet allow the sealant 351 to enhance the bond between adjacent courses of shingles 301 on the roof. FIG. 11*e* depicts another embodiment where a sealant 351 is disposed on the rear surface of the shingle body 302 near the butt edge 303 of the shingle 301. As noted above, complementarily located release materials may be provided so that in a folded or unfolded state, or in a packaged state, sealant lines or strips will be aligned with release material that will prevent sticking between shingles or shingle components at undesired stages of their use.

FIG. 12 shows examples of another type of shingle 301 where a water impermeable sheet top lap portion 321 can be used to provide a shingle 301 having the appearance of a conventional shingle or shingles, yet take advantage of constructions that employ lesser amounts of conventional shingle materials. FIG. 12*a* shows a top view of a product commercially available as Centennial Slate™, available from CertainTeed Corporation, Valley Forge, Pa. FIG. 12*b* shows a shingle body 302 with a portion of the headlap 313 omitted relative to the conventional shingle of FIG. 12*a*. FIG. 12*c* shows a shingle 301 with reduced headlap portion 313 equipped with a water impermeable sheet top lap portion 321.

Figure 12C:
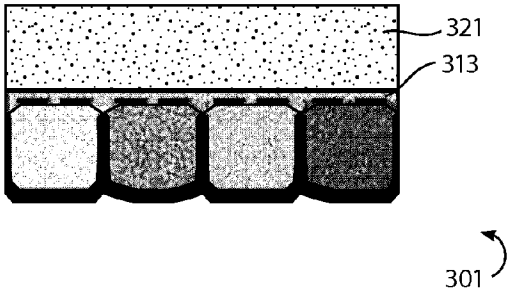
FIGS. 12*a*-12*d* are plan view of still other embodiments of shingles.
Figure 12D:
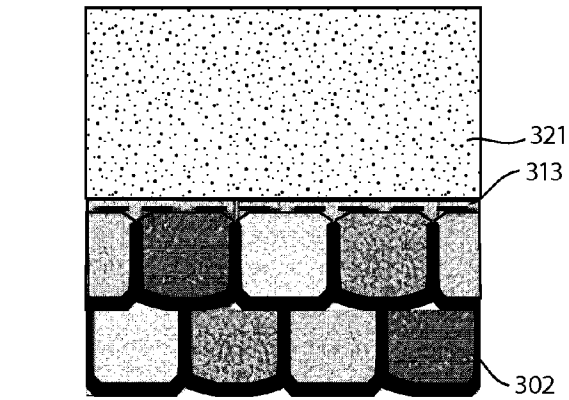
Figure 12A:
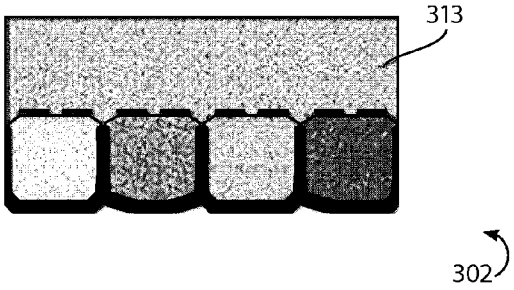
Figure 12B:
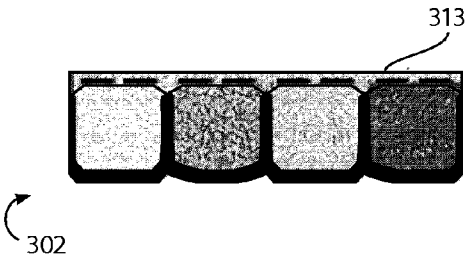

FIG. 12*d* shows a two course look shingle 301 with a top lap portion 321. The two course shingle bodies 302 are laterally offset in the shingle.

The water impermeable sheet making up at least the top lap portion of the shingle can be composed of a variety of different materials. In one aspect it is made up of materials used in conventional roofing membranes such as EPDM or TPO thermoplastic or bituminous membranes commonly used on low slope roofs. In another aspect it is made up of materials such as roofing underlayments such as asphalt coated felt, non-asphaltic fiberglass underlayments or synthetic underlayments. Exemplary synthetic underlayments include, but are not limited to TITANIUM™ synthetic roofing underlayment from InterWrap, Mission, British Columbia, Canada, Tri-Flex® from Grace Construction Products, Cambridge, Mass., Summit® Synthetic Underlayment from Atlas Roofing Corporation, Atlanta, Ga., and the like. In a further aspect the top lap material is made up of a bituminous underlayment material such as one of the WinterGuard™ family of products available from CertainTeed Corporation, Valley Forge, Pa.

In another aspect the water impermeable sheet can be made of a plastic film or sheet of appropriate size, shape, thickness and flexibility to act as a top lap portion of the shingle. Suitable polymers making up such a film or sheet include acrylic sheet, polyvinylchloride sheet, nylons, polyimides, polyurethanes, polyureas, polyolefin copolymers and ionomers, and the like. The films or sheets may be coextruded with protective layers. For example, a polyvinylchloride sheet may include a layer of ASA or AES on the top surface of the top lap portion. The sheet may be flexible or rigid. Polymer coated fabrics may also be employed.

In some embodiments a protective coating of high durability is provided for zones that may experience some exposure to the elements, such as, for example, in the area of the top surface of the top lap portion where pairs of adjacent overlying shingles will meet to form joints in the roof covering. In certain embodiments, printed areas are used on the top lap to indicate lateral offset of shingles to be installed in an overlying course, the portions of the top lap that will underlie the joints being stabilized to weather to a greater extent than other portions of the top lap. In other embodiments, the entire top surface of the top lap is so stabilized. Suitable materials for such protective treatments include fluoropolymer coatings such Kynar based coatings, acrylic coatings, polyurethanes, acrylic urethanes, and the like.

In some embodiments the water impermeable sheet includes a metal foil or sheet. In further embodiments, the impermeable sheet includes a metallized polymer film or sheet, such as, for example a metallized polyester sheet.

Further, the water impermeable sheet can be provided with or without reinforcements of glass, polymeric, carbon or ceramic fibers. The water impermeable sheet can include polymers reinforced with nanomaterials such as nanoparticulate fillers or nanofibers. A fabric-like reinforcement may make up a portion of the water impermeable sheet, such as a woven, a nonwoven, a spunbond, a knitted, a netted, or scrim fabric web or sheet.

Additional ingredients suitable for inclusion in the water impermeable sheet include additives such as colorants, UV stabilizers, thermal stabilizers, antioxidants, antimicrobials and fire retardants. Flame retardants are materials that inhibit or resist the spread of fire. These can be separated into several categories:

a. Minerals such as asbestos, compounds such as aluminum hydroxide, magnesium hydroxide, antimony trioxide, various hydrates, red phosphorus, and boron compounds, mostly borates.

Tetrakis(hydroxymethyl)phosphonium salts, made by passing phosphine gas through a solution of formaldehyde and a mineral acid such as hydrochloric acid, are used as flame retardants for textiles.

Synthetic materials such as halocarbons. These include organochlorines such as polychlorinated biphenyls (PCBs), chlorendic acid derivates (most often dibutyl chlorendate and dimethyl chlorendate) and chlorinated paraffins; organobromines such as polybrominated diphenyl ether (PBDEs), which be further broken down into pentabromodiphenyl ether (pentaBDE), octabromodiphenyl ether (octaBDE), decabromodiphenyl ether (decaBDE) and hexabromocyclododecane (HBCD). Synthetic flame retardant materials also include organophosphates in the form of halogenated phosphorus compounds such as tri-o-cresyl phosphate, tris(2,3-dibromopropyl)phosphate (TRIS), bis(2,3-dibromopropyl) phosphate, tris(1-aziridinyl)-phosphine oxide (TEPA), and others.

Flame retardants can have various mechanisms of function to retard progress of flames and burning of compositions including them. For example, some compounds break down endothermically when subjected to high temperatures. Magnesium and aluminum hydroxides are an example, together with various hydrates, such as alumina trihydrate. The reaction removes heat from the surrounding, thus cooling the material. Care is needed with such flame retardants during processing so as to remain below the decomposition temperature while a product is being manufactured. An alternative mechanism for flame retardance is the dilution of fuel. Inert fillers such as talc or calcium carbonate, act as diluents, lowering the amount of the combustible portion of the material, thus lowering the amount of heat per volume of material that can be produced while burning. Other flame retardants can act through a thermal shielding mechanism. A way to stop spreading of the flame over the material is to create a thermal insulation barrier between the burning and unburned parts. Intumescent additives can be employed to turn the polymer into a carbonized foam, which separates the flame from the material and slows the heat transfer to the unburned fuel. Yet another mechanism for flame retardant action is the dilution of gas phase reactants in the flame. Inert gases such as carbon dioxide and water produced by thermal degradation of some materials act as diluents of the combustible gases, lowering their partial pressures and the partial pressure of oxygen, and slowing the reaction rate to inhibit burning. Still another mechanism for flame retardance is gas phase radical quenching. Chlorinated and brominated materials undergo thermal degradation and release hydrogen chloride and hydrogen bromide. These react with the highly reactive H. and OH. radicals in the flame, resulting in an inactive molecule and a Cl. or Br. radical. The halogen radical has much lower energy than H. or OH., and therefore has much lower potential to propagate the radical oxidation reactions of combustion. Antimony compounds tend to act in synergy with halogenated flame retardants.

In another aspect, the water impermeable sheet includes recycled content. In the case of polymeric based water impermeable sheet materials, the sheet can include various amounts of recycled post-consumer, pre-consumer, post-industrial or industrial waste polymeric materials from the waste stream. In the case of a bituminous membrane based water impermeable sheet, the sheet can include recycled shingle material from industrial sources, or even from shingle tear-off sources.

The water impermeable sheet is attached to the shingle body so as to provide a top lap portion to close the roof to moisture and the elements when it is installed on a roof.

Various methods of attachment are suitable. Among such methods are the use of adhesives, sealants, and welds. Bituminous adhesives may be used to attach the sheet to the shingle body. Other adhesives include polyurethanes, epoxies, butyl adhesives, rubber resin adhesives, and the like. The adhesives may be reactive two part or one part adhesives. In some cases hot melt adhesives are employed. In still other cases, pressure sensitive adhesives may be used to bond the water impermeable sheet to the shingle body. Thermal or sonic welding may be employed to fuse the parts together. Additionally, mechanical attachment methods may also be used in some embodiments to secure the water impermeable sheet and the shingle body one to another. Mechanical attachment approaches include mechanical fasteners, staples, sewing, stitching, rivets, grommets, and the like.

Top lap treatments and arrangements have been described that allow the manufacture and provision of functional shingles having the look and appearance of conventional shingles, yet make use of lower quantities of conventional shingle material by way of reduction of the volume of headlap material employed in an asphaltic or bituminous shingle. Structured elements incorporated in the top lap portion include ridges, troughs, curls, flanges, and other shapes varied dimension that act to provide barriers, channels and pathways for water that may intrude between adjacent shingles on the roof and direct the water downwardly to pass over the lower shingles on the roof as the roof drains. Sealants are also useful features that can be included in continuous, discontinuous, and chevroned fashion in the shingle construction. Multiple dams of sealant can be used. In one embodiment, the back of the water impermeable sheet includes full coverage of a sealant or adhesive for bonding the shingle to the roof deck. The attachment of the water impermeable sheet material can be made to the bottom of the shingle body, or via interlamination between layers of a laminated shingle body. In some instances, the sheet imparts a degree of impact resistance to the shingle body. The water impermeable sheet can be composed of different materials having different functionality as needed beneath the exposure zone of the shingle or in the attachment zone.

In some embodiments, a roofing shingle comprises a shingle body comprising a buttlap portion with a butt edge, a headlap portion with a head edge, a first side edge, a second side edge, an exposure zone has a width that extends from the butt edge toward the headlap portion and is configured to be exposed to the environment when the shingle is installed on a roof, a fastening zone between the exposure zone and the head edge; a water impermeable sheet (WIS) attached to the shingle body, the WIS having a width with an upper edge and a lower edge, the width extends from between about the butt and head edges to beyond the head edge of the shingle body, the width of the shingle body is such that a first distance between the head edge of the shingle body and the upper edge of the water impermeable sheet is equal to or greater than the width of the exposure zone, the length extends approximately between about the first and second side edges, the WIS is formed from a different material than the shingle body, and the WIS provides a top lapping structure that closes a shingled roof to water penetration.

The WIS may be permanently attached to the shingle body, and a width of the headlap portion of the shingle body may be less than the width of the exposure zone. The length of the WIS may be greater than the width of the WIS and the length is greater than half of a length of the shingle body, or the length of the WIS may be less than the width of the WIS and the width of the WIS is greater than width of the shingle body. The width of the WIS may extend downwardly approximately to the butt edge of the shingle body, and the lower edge of the WIS may be proximate the butt edge of the shingle body. The lower edge of the WIS may be offset upwardly from the butt edge of the shingle body. The upward offset may be an amount less than the width of the exposure zone of the shingle body.

Embodiments of the shingle body may emulate two or more courses of conventional shingles. The roofing shingle may be selected from the group consisting of: the two or more courses are secured to each other with an adhesive, wherein the WIS is foldable and connects the two or more courses, wherein the WIS is attached to backs of the two or more courses, wherein the WIS allows an upper course to overlay a lower course, wherein the WIS only overlays portions of the two or more courses, or wherein the WIS overlays entire surfaces of the two or more courses, and the WIS overlays one of the two or more courses and underlays the other of the two or more courses.

The WIS may be selected from the group consisting of: the width of the WIS extends beyond the head edge or beyond the butt edge of at least one of the two or more courses, the WIS has an extension that folds over at least one of the two or more courses, the two or more courses are laterally offset from each other, and the WIS has a shaped portion to accommodate lateral offset between the two or more courses.

The WIS may comprise a structural element having a raised portion configured to provide a dam against moisture intrusion. The structural element may comprise a rigid structure, and the structural element may be selected from the group consisting of: a raised ridge that is generally parallel to the head edge of the shingle body, a plurality of ridges, a folded-over J-shaped flange, a folded-over J-shaped flange and a raised ridge between the flange and the head edge of the shingle body, and a crimped structure such that no additional material is needed to create the structural element. The raised portion may be selected from the group consisting of: adjacent an upper edge of the WIS, adjacent a lower edge of a top lap area above the head edge of the shingle body, a wider raised feature near a lower edge of a top lap adjacent the head edge of the shingle body, curves around the shingle body on a top surface of the WIS, and a second raised portion parallel to the raised portion.

The structural element may comprise a sealant, and the sealant may be selected from the group consisting of: continuous, discontinuous, on a top surface of the WIS, a top surface of the shingle body, a back surface of the WIS, a back surface of the shingle body, a plurality of lines of sealant, arranged in a chevron-like pattern, and a combination thereof. The WIS may be attached to one or more of a front surface, a back surface and a side surface of the shingle body. The roofing shingle may further comprise a reinforcement mounted to a lower surface of the shingle body beneath the exposure zone. The WIS may comprise a reinforcement in a portion beneath the exposure zone of the shingle body.

In other embodiments, the shingle body may comprise a single layer of shingle material or a laminate having a plurality of layers. The shingle body may comprise an asphaltic or bituminous material. The WIS may have a thickness that is less than about 50% of a thickness of the shingle body, less than about 40%, less than about 30%, less than about 20%, less than about 10%, or less than about 5% of the thickness of the shingle body.

Embodiments of the WIS may only extend beyond the head edge of the shingle body. The WIS may not extend beyond the butt edge of the shingle body. The WIS may not extend beyond the buttlap portion of the shingle body. The WIS may be attached to a lower surface of the shingle body.

Embodiments of the WIS may comprise one or more of EPDM, TPO thermoplastic, bituminous membrane, asphalt-coated felt, non-asphaltic fiberglass underlayment, synthetic underlayment, bituminous underlayment material, plastic film, acrylic, polyvinylchloride, nylon, polyimide, polyurethane, polyurea, polyolefin copolymer or ionomer, ASA, AES, fluoropolymer, polyurethane, acrylic urethane, metal foil, metallized polymer film or a combination thereof. The WIS may comprise one or more of glass, polymeric, carbon or ceramic fiber, polymers reinforced with nanomaterial, woven, nonwoven, spunbond, knitted, netted or scrim fabric, colorant, UV stabilizer, thermal stabilizer, antioxidant, antimicrobial, fire retardant, recycled content or a combination thereof.

The WIS may be attached to the shingle body with one or more adhesive, sealant, weld, mechanical attachment or a combination thereof. The WIS may be selected from the group consisting of: a z-fold arrangement with a z-shape, the z-shape has an open downward facing portion in which a head edge of the shingle body is located, the z-shape includes sufficient material to extend downwardly to the butt edge of the shingle body, the sufficient material only extends partially down a back of the shingle body, disposed in substantially a same plane as a front surface of the shingle body, attached to a front face of the shingle body near the head edge, attached to the head edge, a receiver portion attached to the head edge with a portion extending onto a front face of the shingle body near the head edge and another portion extending onto a rear of the shingle body near the head edge, an extension that covers the fastening zone of the shingle body and a portion attached to the head edge, a portion to receive the shingle body that wraps around to a rear surface of the shingle body near the upper edge, extends down to the butt edge of the shingle body on a rear of the shingle, disposed in substantially a same plane as a rear surface of the shingle body, attached to a rear surface of the shingle body near the head edge, extends down to the butt edge of the shingle body on a rear of the shingle, wherein the shingle body is a laminate structure and at least a portion of the WIS is attached to the shingle body between two parts of the laminate structure, approximately in a plane of a front surface of the shingle body with portions extending to a front surface near the head edge and portions wrapping around the head edge of a front most layer of the laminate structure and between the lamina near the head edge of the shingle body, attached to the head edge of a rear layer of the laminate structure with a portion extending between upper edges of the layers near the head edge and the WIS is substantially aligned in a plane between layers of the laminate structure, attached between upper edges of the laminate structure, and disposed between layers of the laminate structure and extends downwardly to the butt edge.

Embodiments of a method of making a roofing shingle may comprise forming a shingle body with a buttlap portion and a butt edge, a headlap portion and a head edge, a first side edge and a second side edge, an exposure zone extending from the butt edge toward the headlap portion that is configured to be exposed to the environment when the shingle is installed on a roof; and attaching a water impermeable sheet (WIS) to the shingle body, the WIS having a width, length, first end and second end, the width extends beyond the head edge, the width of the shingle body is such that a first distance between the head edge of the shingle body and the upper edge of the water impermeable sheet is equal to or greater than the width of the exposure zone, the WIS is formed from a different material than the shingle body, and the WIS provides a top lapping structure that closes a shingled roof to water penetration.

Embodiments of attaching may comprise attaching the WIS to the shingle body after the shingle body is fabricated. Attaching may comprise attaching the WIS to the shingle body while the shingle body is being fabricated. The shingle body may emulate two or more courses of conventional shingles.

Attaching may be selected from the group consisting of: securing the two or more courses to each other with an adhesive, wherein the WIS is foldable and connecting the two or more courses, attaching the WIS to backs of the two or more courses, overlaying a lower course with an upper course with the WIS, overlaying only portions of the two or more courses with the WIS, overlaying entire surfaces of the two or more courses with the WIS, and overlaying one of the two or more courses and underlaying the other of the two or more courses with the WIS. Attaching may be selected from the group consisting of: extending the width of the WIS beyond the head edge of at least one of the two or more courses, extending the WIS to fold over at least one of the two or more courses, laterally offsetting the two or more courses from each other, accommodating a lateral offset of the two or more courses with a shaped portion of the WIS, and forming an asphaltic component on a top surface of the WIS and using the asphaltic component to align the WIS with the shingle body.

Other embodiments of a method of installing roofing shingles may comprise providing a plurality of roofing shingles, each shingle having a shingle body, a water impermeable sheet (WIS) attached to the shingle body and extending therefrom as a headlap, and the WIS is formed from a different material than the shingle body; and fastening the roofing shingles to a roof deck with fasteners in horizontal courses such that adjacent ones of the shingle bodies in a single horizontal course only laterally abut each other, do not overlap adjacent WIS in the same course, and do not overlap adjacent shingle bodies in the same course.

The method may further comprise extending the WIS from the shingle body only as the headlap, extending at least some of the fasteners through the WIS as well as the shingle bodies, or fastening the roofing shingles directly to the roof deck with no underlayment between the roofing shingles and the roof deck.

All patents and patent applications noted in this disclosure are incorporated by reference.

It will be apparent to those skilled in the art that various modifications and variations can be made to the present invention without departing from the scope of the invention. Thus, it is intended that the present invention cover the modifications and variations of this invention provided they come within the scope of the appended claims and their equivalents.

What is claimed is:

1. A roofing shingle, comprising:

a shingle body comprising a buttlap portion with a butt edge, a headlap portion with a head edge, a first side edge, a second side edge, an exposure zone has a width that extends from the butt edge toward the headlap portion and is configured to be exposed to the environment when the shingle is installed on a roof, and a fastening zone between the exposure zone and the head edge; and a water impermeable sheet (WIS) attached to the shingle body, the WIS having a WIS width with an upper edge and a lower edge, the WIS width extends from between about the butt and head edges to beyond the head edge of the shingle body, the width of the shingle body is such that a first distance between the head edge of the shingle body and the upper edge of the WIS is equal to or greater than the width of the exposure zone, a WIS length extends approximately between about the first and second side edges, the WIS is formed from a different material than the shingle body, and the WIS provides a top lapping structure that closes a shingled roof to water penetration; and the WIS comprises a structural element having a raised portion that extends upward from the WIS and is configured to provide a dam against moisture intrusion; and wherein the raised portion terminates below a plane coplanar with an upper surface of the shingle body.

2. The roofing shingle of claim 1, wherein the WIS is permanently attached to the shingle body, the raised portion has a length that extends from about the first side edge to about the second side edge of the shingle body, and a width of the headlap portion of the shingle body is less than the width of the exposure zone.

3. The roofing shingle of claim 1, wherein the length of the WIS is less than the width of the WIS, and the width of the WIS is greater than width of the shingle body;

the raised portion has a length that extends continuously across the WIS length; and the width of the WIS extends downwardly approximately to the butt edge of the shingle body, and the lower edge of the WIS is proximate the butt edge of the shingle body.

4. The roofing shingle of claim 1, wherein the lower edge of the WIS is offset upwardly from the butt edge of the shingle body.

5. The roofing shingle of claim 4, wherein the upward offset is an amount less than the width of the exposure zone of the shingle body.

6. The roofing shingle of claim 1, wherein the shingle body comprises a pair of shingle bodies, the WIS is a single substrate permanently attached to both shingle bodies prior to installation on the roof, and the pair of shingle bodies emulates two or more courses of roofing shingles on the single substrate.

7. The roofing shingle of claim 1, wherein the raised portion comprises a sealant, and the sealant is selected from the group consisting of: continuous, discontinuous, on a top surface of the WIS, a top surface of the shingle body, a back surface of the WIS, a back surface of the shingle body, a plurality of lines of sealant, arranged in a chevron-like pattern, and a combination thereof.

8. The roofing shingle of claim 1, wherein the WIS is attached to a front surface, a back surface and a side surface of the shingle body, and the raised portion is located only above and spaced apart from the headlap portion and head edge of the shingle body.

9. The roofing shingle of claim 1, wherein the roofing shingle further comprises a reinforcement mounted to a lower surface of the shingle body beneath the exposure zone.

10. The roofing shingle of claim 1, wherein the shingle body comprises an asphaltic or bituminous material, and further comprising an additional asphalt component spaced apart from the shingle body and formed on a surface of the WIS, and the additional asphalt component is configured for alignment purposes.

11. The roofing shingle of claim 1, wherein the WIS has a thickness that is less than about 10% of the thickness of the shingle body.

12. The roofing shingle of claim 1, wherein the WIS only extends beyond the head edge of the shingle body.

13. The roofing shingle of claim 1, wherein the WIS is attached to a lower surface of the shingle body.

14. The roofing shingle of claim 1, wherein the WIS comprises one or more of EPDM, TPO thermoplastic, bituminous membrane, asphalt-coated felt, non-asphaltic fiberglass underlayment, synthetic underlayment, bituminous underlayment material, plastic film, acrylic, polyvinylchloride, nylon, polyimide, polyurethane, polyurea, polyolefin copolymer or ionomer, ASA, AES, fluoropolymer, polyurethane, acrylic urethane, metal foil, metallized polymer film or a combination thereof.

15. The roofing shingle of claim 1, wherein the WIS is attached to the shingle body with one or more adhesive, sealant, weld, mechanical attachment or a combination thereof.

16. The roofing shingle of claim 1, wherein the structural element comprises a rigid structure.

17. The roofing shingle of claim 1, wherein the structural element is selected from the group consisting of: a raised, thickened and unfolded ridge that is generally parallel to the head edge of the shingle body, a plurality of thickened and unfolded ridges, a folded-over J-shaped flange, and a folded-over J-shaped flange and a raised ridge between the flange and the head edge of the shingle body.

18. The roofing shingle of claim 1, wherein the raised portion is adjacent an upper edge of the WIS, or curves around the shingle body on a top surface of the WIS.

19. A roofing shingle, comprising:

a pair of shingle bodies, each comprising a buttlap portion with a butt edge, a headlap portion with a head edge, a first side edge, a second side edge, an exposure zone has a width that extends from the butt edge toward the headlap portion and is configured to be exposed to the environment when the shingle is installed on a roof, a fastening zone between the exposure zone and the head edge;

a water impermeable sheet (WIS) comprising a single substrate attached to both of the shingle bodies, the WIS having a WIS width with an upper edge and a lower edge, the WIS width extends from between about the butt and head edges to beyond the head edge of the shingle body, the width of the shingle body is such that a first distance between the head edge of the shingle body and the upper edge of the WIS is equal to or greater than the width of the exposure zone, a WIS length extends approximately between about the first and second side edges, the WIS is formed from a different material than the shingle body, and the WIS provides a top lapping structure that closes a shingled roof to water penetration; and the shingle bodies emulate two or more courses of roofing shingles on the single substrate; and wherein the WIS comprises a structural element having a raised portion that extends upward from the WIS, and wherein the raised portion terminates below a plane coplanar with an upper surface of the shingle body.

20. The roofing shingle of claim 19, wherein the roofing shingle is selected from the group consisting of: wherein the WIS is foldable and connects the two or more courses, wherein the WIS is attached to backs of the two or more courses, wherein the WIS allows an upper course to overlay a lower course, wherein the WIS only overlays portions of the two or more courses, or wherein the WIS overlays entire surfaces of the two or more courses, and the WIS overlays one of the two or more courses and underlays the other of the two or more courses.

21. The roofing shingle of claim 19, wherein the WIS is selected from the group consisting of: the width of the WIS extends beyond the head edge or beyond the butt edge of at least one of the two or more courses, the two or more courses are laterally offset from each other, and the WIS has a shaped portion to accommodate lateral offset between the two or more courses.

* * * * *

UNITED STATES PATENT AND TRADEMARK OFFICE

CERTIFICATE OF CORRECTION

PATENT NO. : 8,898,987 B1
APPLICATION NO. : 13/667418
DATED : December 2, 2014
INVENTOR(S) : Anna M. Amatruda et al.

It is certified that error appears in the above-identified patent and that said Letters Patent is hereby corrected as shown below:

Title Page:
On page 2, (56), under "OTHER PUBLICATIONS", please add --Technical search, 4 pgs, 2012--

Signed and Sealed this
Twenty-second Day of September, 2015

Michelle K. Lee

Michelle K. Lee
*Director of the United States Patent and Trademark Office*